US011446536B2

(12) United States Patent
Lagree et al.

(10) Patent No.: US 11,446,536 B2
(45) **Date of Patent: *Sep. 20, 2022**

(54) ADJUSTABLE EXERCISE MACHINE

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US)

(73) Assignee: Lagree Technologies, Inc., Chatsworth (CA)

( * ) Notice: Subject to any disclaimer, the term of this patent is extended or adjusted under 35 U.S.C. 154(b) by 60 days.

This patent is subject to a terminal disclaimer.

(21) Appl. No.: 17/227,584

(22) Filed: Apr. 12, 2021

(65) Prior Publication Data

US 2021/0228933 A1 Jul. 29, 2021

Related U.S. Application Data

(63) Continuation of application No. 16/521,798, filed on Jul. 25, 2019, now Pat. No. 10,974,092.
(Continued)

(51) Int. Cl.
*A63B 21/068* (2006.01)
*A63B 22/20* (2006.01)
(Continued)

(52) U.S. Cl.
CPC ..... *A63B 21/068* (2013.01); *A63B 21/00069* (2013.01); *A63B 21/0428* (2013.01);
(Continued)

(58) Field of Classification Search
CPC ..... A63B 2022/002; A63B 2022/0033; A63B 2022/0035; A63B 2022/0051;
(Continued)

(56) References Cited

U.S. PATENT DOCUMENTS 1,621,477 A 8/1925 Pilates
1,866,868 A 7/1932 Thomson
(Continued)

FOREIGN PATENT DOCUMENTS

EP 0354785 A2 2/1990
KR 101226434 B1 1/2013
(Continued)

OTHER PUBLICATIONS http://www.walmart.com/ip/total-gym-1400/23816097?adid=15000000000000027727770; Webpage from Walmart.com for the Total Gym 1400; Received and Printed Aug. 25, 2014.
(Continued)

*Primary Examiner* — Nyca T Nguyen
*Assistant Examiner* — Zachary T Moore
(74) *Attorney, Agent, or Firm* — Neustel Law Offices

(57) ABSTRACT

An adjustable exercise machine for performing resistance exercises comprises a base and an upper frame including front and back end stationary exercise platforms, and a movable exercise platform that reciprocates between the stationary platforms. A plurality of biasing members is selectable by an exerciser via selector knobs to generate a bias force against the movable platform. A plurality of pivotable lift supports are connected between the base and the upper frame. Front and back actuators are connected between the base and the lift supports by lifting yokes to selectively raise and lower the front and back ends of the machine. The movable platform may be connected to move along the exercise machine by trolley wheel assemblies. A plurality of travel limit decelerators mounted on the rails engage and rapidly decelerates the movable platform as it reaches its limits of travel on the rails.

20 Claims, 19 Drawing Sheets

Related U.S. Application Data

(60) Provisional application No. 62/703,062, filed on Jul. 25, 2018.

(51) Int. Cl.
*A63B 21/00* (2006.01)
*A63B 21/04* (2006.01)
*A63B 71/00* (2006.01)

(52) U.S. Cl.
CPC ..... *A63B 21/4033* (2015.10); *A63B 21/4035* (2015.10); *A63B 22/208* (2013.01); *A63B 71/0054* (2013.01); *A63B 2071/0063* (2013.01); *A63B 2071/0072* (2013.01); *A63B 2225/09* (2013.01)

(58) Field of Classification Search
CPC .... A63B 2022/0053; A63B 2022/0079; A63B 2022/0082; A63B 2022/0084; A63B 21/00185; A63B 21/0083; A63B 21/0084; A63B 21/00845; A63B 21/0085; A63B 21/0087; A63B 21/0088; A63B 21/02; A63B 21/026; A63B 21/04; A63B 21/0407; A63B 21/0414; A63B 21/0421; A63B 21/0428; A63B 21/05; A63B 21/055; A63B 22/00; A63B 22/0015; A63B 22/0017; A63B 22/0023; A63B 22/0046; A63B 22/0048; A63B 22/0056; A63B 22/0061; A63B 22/0064; A63B 22/0066; A63B 22/0069; A63B 22/0076; A63B 22/0087; A63B 22/089; A63B 22/14; A63B 22/16; A63B 2210/50; A63B 2210/56
See application file for complete search history.

(56) References Cited

U.S. PATENT DOCUMENTS 3,770,267 A 11/1973 McCarthy
4,240,627 A 12/1980 Brentham
4,759,540 A 7/1988 Yu
4,798,378 A 1/1989 Jones
5,066,005 A 11/1991 Luecke
5,141,480 A 8/1992 Lennox
5,263,913 A 11/1993 Boren
D362,700 S 9/1995 Breibart
5,460,596 A 10/1995 Brady
D382,319 S 8/1997 Gerschefske
5,681,249 A 10/1997 Endelman
5,782,639 A 7/1998 Beal
5,820,478 A * 10/1998 Wood ..... A63B 69/3652 473/279
5,885,197 A 3/1999 Barton
5,895,340 A 4/1999 Keller
5,967,955 A 10/1999 Westfall
6,179,753 B1 1/2001 Barker
6,761,667 B1 7/2004 Cutler
6,796,927 B2 9/2004 Toyama
6,851,144 B2 2/2005 Wang
7,163,500 B2 1/2007 Endelman
7,270,628 B2 9/2007 Campanaro
7,530,929 B2 5/2009 Feldman
7,803,095 B1 9/2010 Lagree
7,931,570 B2 4/2011 Hoffman
7,935,032 B1 5/2011 Jackson
7,998,043 B2 8/2011 Zhou
8,012,073 B2 9/2011 Barnett
8,192,332 B2 6/2012 Baker
8,249,714 B1 8/2012 Hartman
8,356,996 B2 1/2013 Mayrhofer
8,585,554 B2 11/2013 Shavit
8,641,585 B2 2/2014 Lagree
8,721,506 B2 5/2014 Gerschefske
8,734,307 B2 5/2014 Bathey
8,764,609 B1 7/2014 Elahmadie
8,858,409 B2 10/2014 Trees
8,870,726 B2 10/2014 Watterson
9,022,909 B2 5/2015 Kermath
9,038,218 B1 5/2015 Heil
9,050,517 B2 6/2015 Oliver
9,125,785 B2 9/2015 Trees
9,132,051 B2 9/2015 Heil
9,339,712 B2 5/2016 De Biasi
9,539,462 B2 1/2017 Carter
10,046,193 B1 8/2018 Aronson
2001/0056011 A1 12/2001 Endelman
2002/0022551 A1 2/2002 Watterson
2003/0078138 A1 4/2003 Toyama
2003/0119635 A1 6/2003 Arbuckle
2004/0077464 A1 4/2004 Feldman
2004/0142800 A1 7/2004 Gerschefske
2004/0248710 A1 12/2004 Rodgers, Jr.
2005/0130810 A1 6/2005 Sands
2005/0164856 A1 7/2005 Parmater
2006/0046914 A1 3/2006 Endelman
2006/0172862 A1 8/2006 Badarneh
2006/0199712 A1 9/2006 Barnard
2006/0211543 A1 9/2006 Feldman
2006/0293156 A1 12/2006 Trees
2008/0070765 A1 3/2008 Brown
2008/0242511 A1 10/2008 Munoz
2008/0248935 A1* 10/2008 Solow ..... A63B 21/154 482/142
2009/0023556 A1 1/2009 Daly
2009/0156372 A1 6/2009 Solomon
2009/0203505 A1 8/2009 Kroll
2009/0209393 A1 8/2009 Crater
2010/0056289 A1 3/2010 Zhou
2010/0227748 A1 9/2010 Campanaro
2011/0039669 A1 2/2011 Stewart
2011/0082016 A1 4/2011 Kim
2011/0143898 A1 6/2011 Trees
2011/0152032 A1 6/2011 Barnett
2011/0166002 A1 7/2011 Savsek
2011/0172069 A1 7/2011 Gerschefske
2012/0071301 A1 3/2012 Kaylor
2012/0088634 A1 4/2012 Heidecke
2012/0122637 A1 5/2012 Bathey
2012/0283079 A1* 11/2012 Solow ..... A63B 21/00065 482/142
2012/0295771 A1* 11/2012 LaGree ..... A63B 22/203 482/94
2013/0008452 A1 1/2013 Evangelos
2013/0150219 A1 6/2013 Chang
2013/0196835 A1 8/2013 Solow
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2015/0011362 A1 1/2015 Oh
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree

(56) References Cited

U.S. PATENT DOCUMENTS

| | | | | |
|---|---|---|---|---|
| 2016/0166870 | A1* | 6/2016 | Lagree | A63B 24/0087 482/142 |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1* | 10/2017 | Lagree | A63B 21/00069 |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0178053 | A1 | 6/2018 | Lagree | |
| 2018/0193691 | A1 | 7/2018 | Lagree | |
| 2018/0250551 | A1 | 9/2018 | Lagree | |
| 2018/0250573 | A1 | 9/2018 | Lagree | |
| 2018/0272179 | A1 | 9/2018 | Lagree | |
| 2018/0280782 | A1 | 10/2018 | Lagree | |
| 2018/0318627 | A1 | 11/2018 | Lagree | |
| 2018/0318646 | A1 | 11/2018 | Lagree | |
| 2018/0326252 | A1 | 11/2018 | Lagree | |
| 2018/0353803 | A1 | 12/2018 | Lagree | |
| 2018/0361190 | A1 | 12/2018 | Lagree | |
| 2018/0361197 | A1 | 12/2018 | Lagree | |
| 2019/0083842 | A1 | 3/2019 | Lagree | |
| 2019/0160320 | A1 | 5/2019 | Lagree | |
| 2019/0160329 | A1 | 5/2019 | Lagree | |

FOREIGN PATENT DOCUMENTS

| | | | |
|---|---|---|---|
| WO | 2004096376 | A1 | 11/2004 |
| WO | 2008010797 | A1 | 1/2008 |

OTHER PUBLICATIONS

International Search Report and Written Opinion for PCT/US2015/033463; dated Dec. 15, 2016.

International Search Report and Written Opinion for PCT/US2017/028393; dated Jul. 11, 2017.

https://web.archive.org/web/20140707224029/http://solidmasters.com/; www.SolidMasters.com Website Page via Archive.org; Jul. 7, 2014.

https://web.archive.org/web/20140707224029/http://solidmasters.com/; Picture from www.SolidMasters.com Page via Archive.org; Jul. 7, 2014.

EPO Search Report for Application No. EP15807353.6; dated Feb. 9, 2018.

https://www.youtube.com/watch?v=froSxJ3T6jE; Screenshot at 1:52 of YouTube Video "Megaformer Evolution Promo"; Sep. 1, 2014.

PCT Preliminary Report on Patentability and Opinion for PCT/US2017/028393; dated Nov. 1, 2018.

* cited by examiner

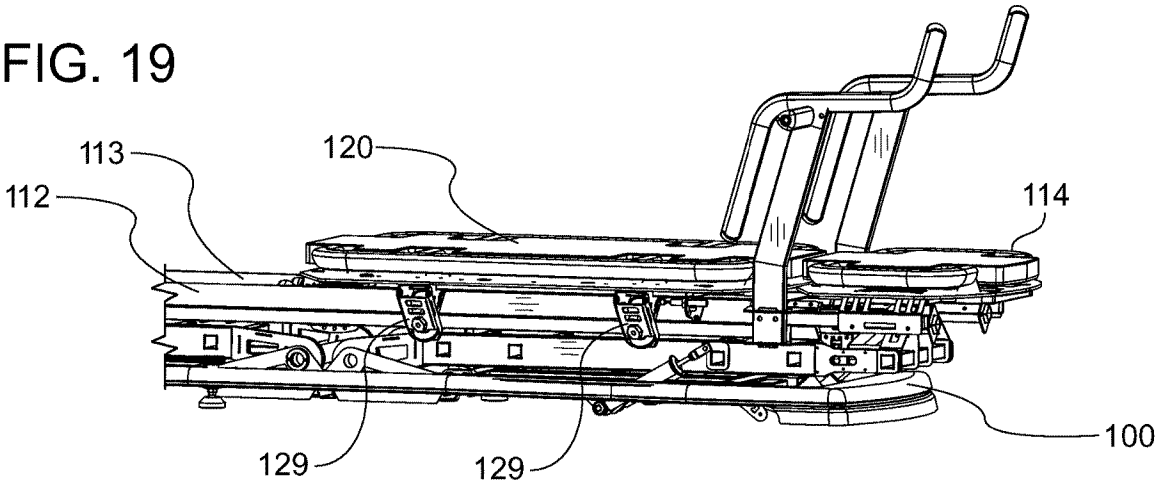
FIG. 19
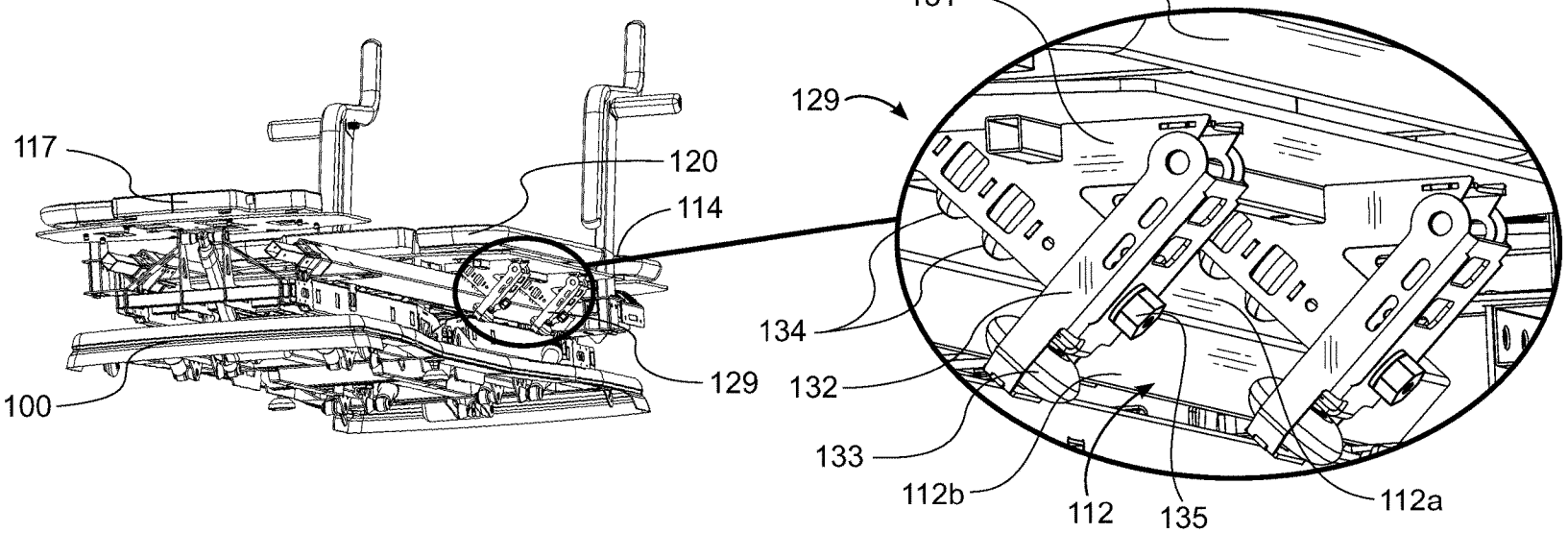
FIG. 20B
FIG. 20A

ADJUSTABLE EXERCISE MACHINE

CROSS REFERENCE TO RELATED APPLICATIONS

The present application is a continuation of U.S. application Ser. No. 16/521,798 filed on Jul. 25, 2019 which issues as U.S. Pat. No. 10,974,092 on Apr. 13, 2021 (Docket No. LAGR-192), which claims priority to U.S. Provisional Application No. 62/703,062 filed Jul. 25, 2018 (Docket No. LAGR-166). Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to the field of fitness training devices and exercise machines. More specifically, example embodiments relate to an exercise machine comprising a plurality of exercise platforms and supported by a plurality of repositionable arms, a plurality of actuators, and a plurality of shock absorbers operable to reposition the exercise platforms relative to a substantially horizontal axis.

Related Art

Any discussion of the related art throughout the specification should in no way be considered as an admission that such related art is widely known or forms part of common general knowledge in the field.

Resistance exercise machines of the type having a sliding, substantially horizontal exercise platform, such as Pilates apparatuses or stationary rowing machines, are intended to provide for resistance training by moving the platform reciprocally along one or more longitudinal rails that guide the platform's linear movement during exercise. Fitness trainers will appreciate that when exercisers lift all or a portion of their own body weight during a resistance exercise they experience an increase in caloric energy consumption and accelerated muscle fatigue. This has the benefit to exercisers of reducing the amount of exercise time required to achieve desired results compared to exercising without lifting a portion of their body weight.

Reducing the duration of exercisers' training sessions also provides a commercial benefit for fitness facilities. Many fitness facilities generate revenue based on the number of exercisers they can serve during their hours of operation. Reducing the duration of individual exercisers' training sessions increases the number of exercisers who can sequentially use facilities' exercise machines during the hours of operation, thus increasing revenue. Therefore, facility owners, fitness trainers, and exercisers all will appreciate the benefits of increased cardiovascular exercise on a machine comprising a movable platform and that can be elevated at one or both ends to add or subtract a portion of the exerciser's body weight to the baseline level of resistance provided for by the exercise machine.

SUMMARY

Example embodiments are directed to a novel exercise machine for performing resistance exercises. An example machine generally comprises a lower support structure and an upper exercise structure that includes front and back stationary exercise platforms and a movable exercise platform. A plurality of resistance springs with selector knobs enable an exerciser to select and apply a bias force against the movable platform.

The exercise platforms are arranged in a common plane. In one position the platforms are substantially aligned in a horizontal plane. However, the distal ends of the machine may be selectively raised or lowered via the operation of cooperating components to incline the plane and add or subtract a variable portion of the exerciser's body weight to the resistance level provided by the exercise machine itself. This provides an efficient method for increasing the intensity of the exerciser's training and for shortening the exercise time needed for the exerciser to achieve desired results.

A plurality of novel trolley wheel assemblies support the movable platform on a pair of parallel rails and allow it to reciprocate between the stationary platforms. The rails include adjacent upper and lower sloped surfaces that are substantially perpendicular. The trolley wheel assemblies include a plurality of load wheels in rolling engagement with the upper sloped surfaces of the rails and at least one clamp wheel in rolling engagement with the lower sloped surfaces of the rails thereby minimizing lateral and uplift movement of the movable platform during exercise.

A plurality of travel limit decelerators are mounted on the rails at locations intended to engage the movable platform as it reaches its limits of travel on the rails. The travel limit decelerators function to rapidly and smoothly decelerate and bring the platform to a stop without damaging the platform or other machine components.

There has thus been outlined, rather broadly, some of the embodiments of the adjustable exercise machine in order that the detailed description thereof may be better understood, and in order that the present contribution to the art may be better appreciated. There are additional embodiments of the adjustable exercise machine that will be described hereinafter and that will form the subject matter of the claims appended hereto. In this respect, before explaining at least one embodiment of the adjustable exercise machine in detail, it is to be understood that the adjustable exercise machine is not limited in its application to the details of construction or to the arrangements of the components set forth in the following description or illustrated in the drawings. The adjustable exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 19 is a perspective view of an adjustable exercise machine with a trolley wheel assembly in accordance with an example embodiment.

FIG. 20A is a perspective view of an adjustable exercise machine with a trolley wheel assembly in accordance with an example embodiment.

FIG. 20B is a close-up perspective view of a trolley wheel assembly of an adjustable exercise machine in accordance with an example embodiment.

DETAILED DESCRIPTION

Figure 1:
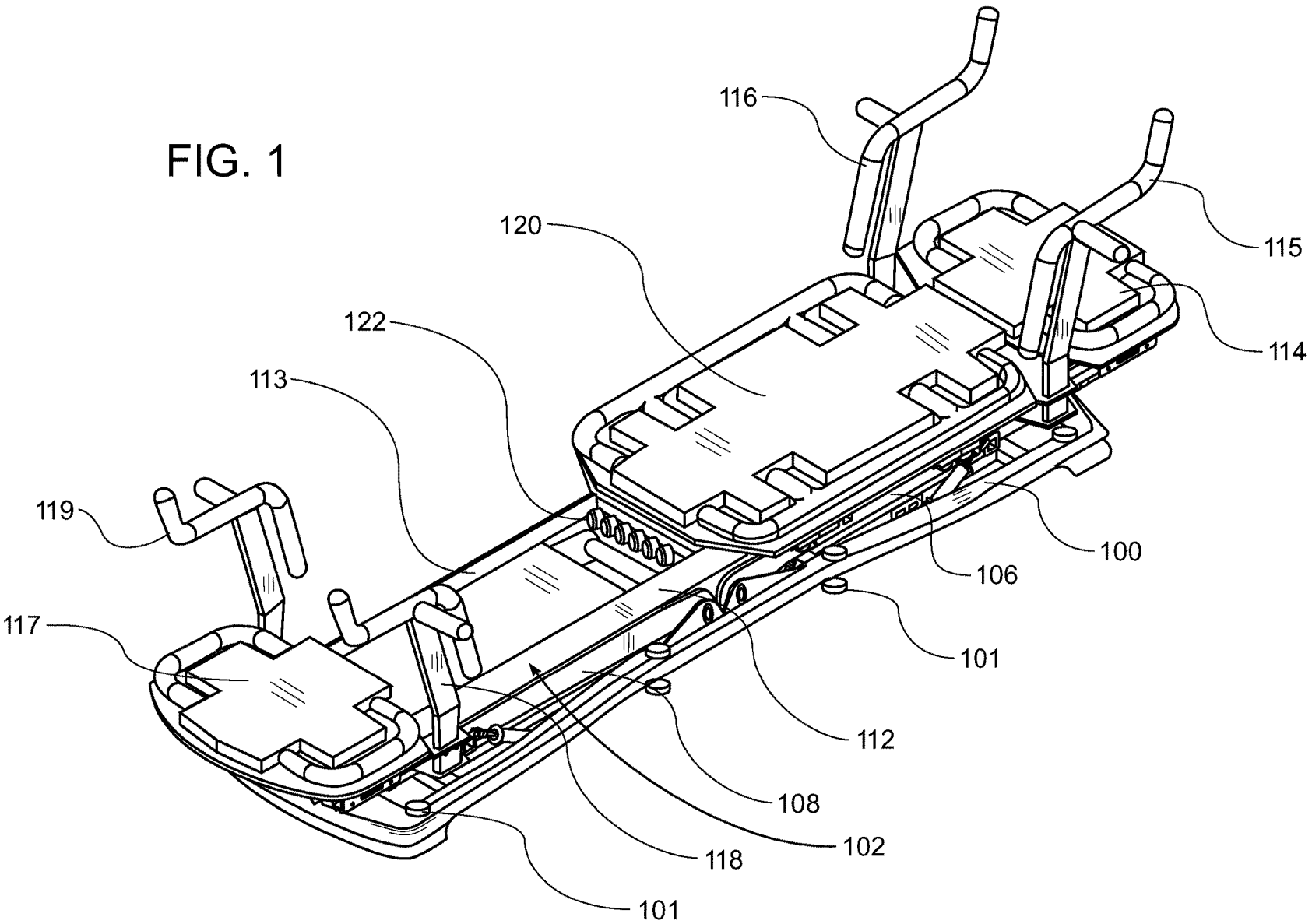
FIG. 1 is a perspective view of an adjustable exercise machine in accordance with an example embodiment.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

The phrase "linear actuator" is used herein to mean a device used to create linear motion by means of moving an extensible/retractable first portion of an actuator relative to a second portion of the actuator, the distal ends of the first and second portions preferably being affixed to a first and second structure of an exercise machine. The particular linear actuators described in connection with the example embodiments described below are not intended to be limiting. Rather, one or more types of linear actuators well known to those skilled in the art may be used including, but not limited to mechanical, pneumatic, hydraulic, or electromechanical actuators.

The terms slidable, rollable, and/or movable and variations thereof may be used herein to describe an exercise platform that is able to move reciprocally on an exercise support structure. These descriptors are used interchangeably and are not intended to limit the manner in which the platform moves or the specific structures that implement the movement.

Although more than one embodiment may be illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein, including combinations of embodiments or portions thereof.

A. Overview

An example embodiment of an improved exercise machine 110 for performing resistance exercises generally comprises a base 100 and an upper frame 111 that includes front and back end stationary exercise platforms 114, 117 and a movable exercise platform 120. The stationary and movable platforms 114, 117, 120 are arranged in a common plane. A plurality of biasing members 121 with selector knobs 122 are connectable between a stationary component of the machine and the movable platform 120 and enable an exerciser to select and apply a bias force against the movable platform 120.

A plurality of pivotable front and back jib arms 106, 107, 108, 109 are connected between the base 100 and the upper structure 111. Front and back actuators 125, 126 are connected between the support structure 100 and the jib arms 106, 107, 108, 109 by lifting yokes 128 and are operable to selectively raise and lower the front and back ends of the machine 110 to raise and/or incline the plane of the exercise platforms 114, 117 as desired.

The movable platform 120 is operable by an exerciser to reciprocate between the stationary front and back end platforms 114, 117. The movable platform 120 is supported on a pair of parallel rails 112, 113 by a plurality of trolley wheel assemblies 129, 130. The rails 112, 113 include adjacent upper and lower sloped surfaces that are substantially perpendicular. The trolley wheel assemblies 129, 130 include a plurality of load wheels 134 in rolling engagement with the upper sloped surfaces of the rails 112, 113 and at least one clamp wheel 133 having an axis of rotation substantially perpendicular to the load wheels 134 in rolling engagement with the lower sloped surfaces of the rails 112, 113.

A plurality of travel limit decelerators 137 are mounted on the rails 112, 113 at locations where they will be engaged by the movable platform 120 as it reaches its limits of travel on the rails 112, 113. The travel limit decelerators 137 function to rapidly and smoothly decelerate and bring the movable platform 120 to a stop without damaging the platform 120 or other machine components.

Another example embodiment of an exercise machine 110 comprises a base 100, an upper frame 111 having at least one track 102, a first end 155 and a second end 156 opposite the first end 155, wherein the upper frame 111 includes a central longitudinal axis and wherein the at least one track 102 has a longitudinal axis. A platform 120 is moveably connected to the at least one track 102 and adapted to be moveable along at least a portion of the longitudinal axis of the at least one track 102. At least one biasing member 121 is connected to the movable platform 120, wherein the at least one biasing member 121 provides a resistance force to the platform 120. A first lift support 160 is connected between the base 100 and the upper frame 111, wherein the first lift support 160 is connected to the upper frame 111 at or near the first end 155 of the upper frame 111. A second lift support 163 is connected between the base 100 and the upper frame 111, wherein the second lift support 163 is connected to the upper frame 111 at or near the second end 156 of the upper frame 111. A first actuator 125 is connected between the base 100 and the first lift support 160 and a second actuator 126 is connected between the base 100 and the second lift support 163, wherein the first actuator 125 is operable to lift or lower the first end 155 of the upper frame 111 with respect to the base 100 and the second actuator 126 is operable to lift or lower the second end 156 of the upper frame 111 with respect to the base 100.

The first lift support 160 may comprise a first pair of distally-spaced arms 106, 107 and a first lifting yoke **128*a* connected between the first pair of distally-spaced arms 106, 107, wherein the first lifting yoke 128*a* is connected to the upper frame 111 at or near the first end 155 of the upper frame 111. The second lift support 163 may comprise a second pair of distally-spaced arms 108, 109 and a second lifting yoke 128*b* connected between the second pair of distally-spaced arms 108, 109, wherein the second lifting yoke 128*b* is connected to the upper frame 111 at or near the first end 155 of the upper frame 111**.

The first lift support 160 comprises a first end 161 and a second end 162, wherein the first end 161 of the first lift support 160 is connected at or near a midpoint of the base 100 and the second end 162 of the first lift support 160 is connected to the upper frame 111 at or near the first end 155 of the upper frame 111. The second lift support 163 comprises a first end 164 and a second end 165, wherein the first end 164 of the second lift support 163 is connected at or near the midpoint of the base 100 and the second end 165 of the second lift support 163 is connected at or near the second end 156 of the upper frame 111.

A first shock absorber 127 may be connected between the base 100 and the first lift support 160 a second shock absorber 127 may be connected between the base 100 and the second lift support 163. The base 100 may comprise a first transverse structural member 124, wherein the first shock absorber 127 is connected to the first transverse structural member 124 of the base 100. The base 100 may comprise a second transverse structural member 124, wherein the second shock absorber 127 is connected to the second transverse structural member 124 of the base 100. A travel limit decelerator 137 may be connected to the first end or the second end of the at least one track 102, the travel limit decelerator 137 being adapted to decelerate the platform 120 when the platform 120 approaches the first end or the second end of the at least one track 102, wherein the travel limit decelerator 137 comprises a decelerator body 139 including a shaft 140 and a decelerator plunger 141.

Another exemplary embodiment may comprise a base 100, an upper frame 111 having at least one track 102, a first end 155 and a second end 156 opposite the first end 155, wherein the upper frame 111 includes a central longitudinal axis and wherein the at least one track 102 has a longitudinal axis, wherein the at least one track 102 comprises a first rail 112 and a second rail 113, wherein the first rail 112 is parallel with respect to the second rail 113. A platform 120 may be moveably connected to the at least one track 102 and adapted to be moveable along at least a portion of the longitudinal axis of the at least one track 102.

A first trolley assembly 129 is connected to the platform 120, wherein the first trolley assembly 129 comprises a first wheel 133 adapted to move along a first surface **112*a* of the first rail 112 and a second wheel 134 adapted to move along a second surface 112*b* of the first rail 112. A second trolley assembly 130 is connected to the platform 120, wherein the second trolley assembly 130 comprises a first wheel 133 adapted to move along a first surface 113*a* of the second rail 113 and a second wheel 134 adapted to move along a second surface 113*b* of the second rail 113. At least one biasing member 121 is connected to the platform 120, wherein the at least one biasing member 121 provides a resistance force to the platform 120. A first actuator 125 is connected between the base 100 and the upper frame 111 and a second actuator 126 is connected between the base 100 and the upper frame 111, wherein the first actuator 125 is operable to lift or lower the first end 155 of the upper frame 111 with respect to the base 100 and the second actuator 126 is operable to lift or lower the second end 156 of the upper frame 111 with respect to the base 100**.

The platform 120 may comprise a first side, a second side, and a lower end, wherein the first trolley assembly 129 is connected to the lower end of the platform 120 at or near the first side of the platform 120 and the second trolley assembly 130 is connected to the lower end of the platform 120 at or near the second side of the platform 120. The first surface 112*a* of the first rail 112 may be perpendicular with respect to the second surface 112*b* of the first rail 112 and the first surface 113*a* of the second rail 113 may be perpendicular with respect to the second surface 113*b* of the second rail 113.

Yet another exemplary embodiment may comprise a base 100, an upper frame 111 having at least one track 102, a first end 155 and a second end 156 opposite the first end 155, wherein the upper frame 111 includes a central longitudinal axis and wherein the at least one track 102 has a longitudinal axis, wherein the at least one track 102 comprises a first rail 112 and a second rail 113. A platform 120 is moveably connected to the at least one track 102 and adapted to be moveable along at least a portion of the longitudinal axis of the at least one track 102. At least one biasing member 121 is connected to the platform 120, wherein the at least one biasing member 121 provides a resistance force to the platform 120.

A first lift support 160 is connected between the base 100 and the upper frame 111, wherein the first lift support 160 is connected to the upper frame 111 at or near the first end 155 of the upper frame 111, wherein the first lift support 160 comprises a first arm 106, a second jib 107, and a yoke 128*a* connected between the first arm 106 and the second jib 107. A second lift support 163 is connected between the base 100 and the upper frame 111, wherein the second lift support 163 is connected to the upper frame 111 at or near the second end 156 of the upper frame 111, wherein the second lift support 163 comprises a first jib 108, a second jib 109, and a yoke 128*b* connected between the first jib 108 and the second jib 109. A first actuator 125 is connected between the base 100 and the first lift support 160 and a second actuator 126 is connected between the base 100 and the second lift support 163, wherein the first actuator 125 is operable to lift or lower the first end 155 of the upper frame 111 with respect to the base 100 and the second actuator 126 is operable to lift or lower the second end 156 of the upper frame 111 with respect to the base 100. The yoke 128*a* of the first lift support 160 is connected to both the first rail 112 and the second rail 113 at or near the first end 155 of the upper frame 111 and the yoke 128*b* of the second lift support 163 is connected to both the first rail 112 and the second rail 113 at or near the second end 156 of the upper frame 111.

B. Adjustable Exercise Machine

Referring primarily to FIG. 1, an example exercise machine 110 is substantially elongated and has a longitudinal axis. The exercise machine 110 comprises opposite proximal and distal ends that are spaced apart along the longitudinal axis and that constitute front and back ends of the machine 110. The machine 110 also comprises opposite elongated lateral sides that extend between the front and back ends.

As shown in FIGS. 1-18, the exemplary exercise machine 110 further comprises a base 100 and an upper frame 111. The base 100 may be supported on a ground surface or a floor by one or more leveling feet 101, or the base 100 may rest directly against the ground surface or floor. The upper frame 111 may comprise a first end 155 (front end) and a second end 156 (rear end).

As shown in FIGS. 1-5, 8, and 9, the track 102 extends from the first end 155 of the frame 111 to the second end 156 of the frame 111. The track 102 may comprise a first rail 112 (right rail) and a second rail 113 (left rail), with the pair of rails 112, 113 extending parallel with each other. In other embodiments, the track 102 may comprise a single beam, rail, or other type of elongated member along which the platform 120 may be moved.

As best shown in FIGS. 10A and 15-17, a first lift support 160 is connected between the base 100 and the upper frame 111 so as to lift or lower the first end 155 of the upper frame 111 with respect to the base 100. Similarly, a second lift support 163 is connected between the base 100 and the upper frame 111 so as to lift or lower the second end 156 of the upper frame 111 with respect to the base 100.

Figure 15:
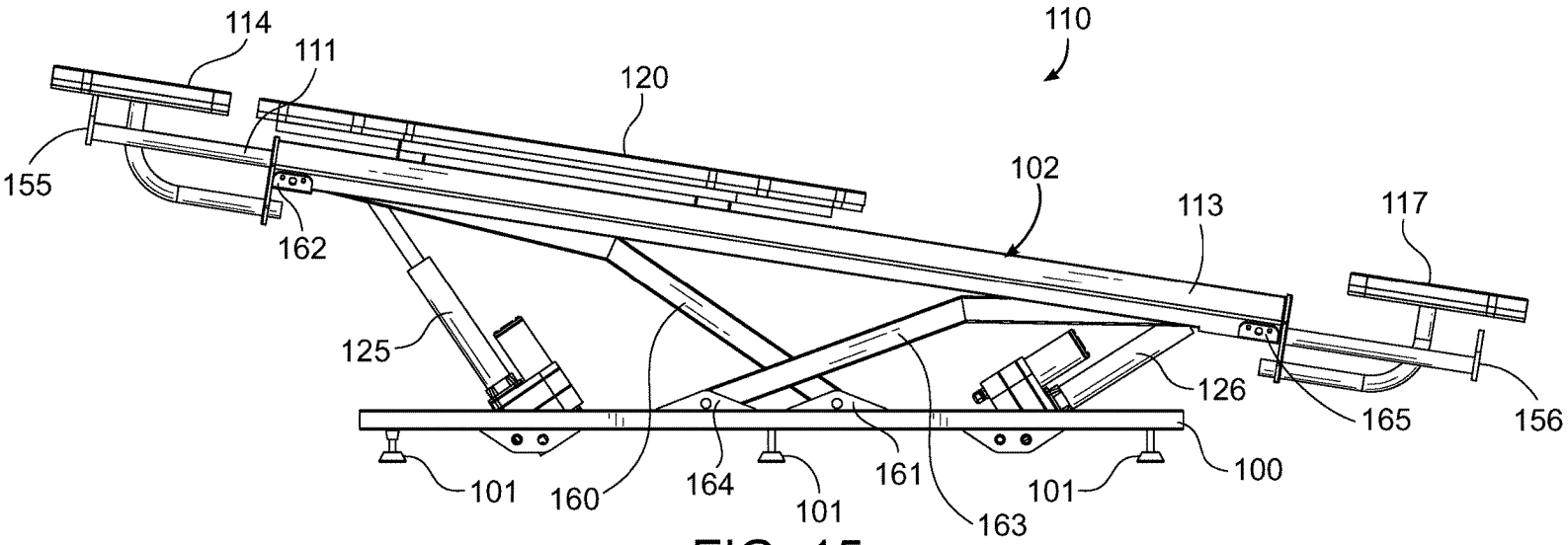
FIG. 15 is a side view of an adjustable exercise machine with the first end of its upper frame in a lifted position in accordance with an example embodiment.
Figure 16:
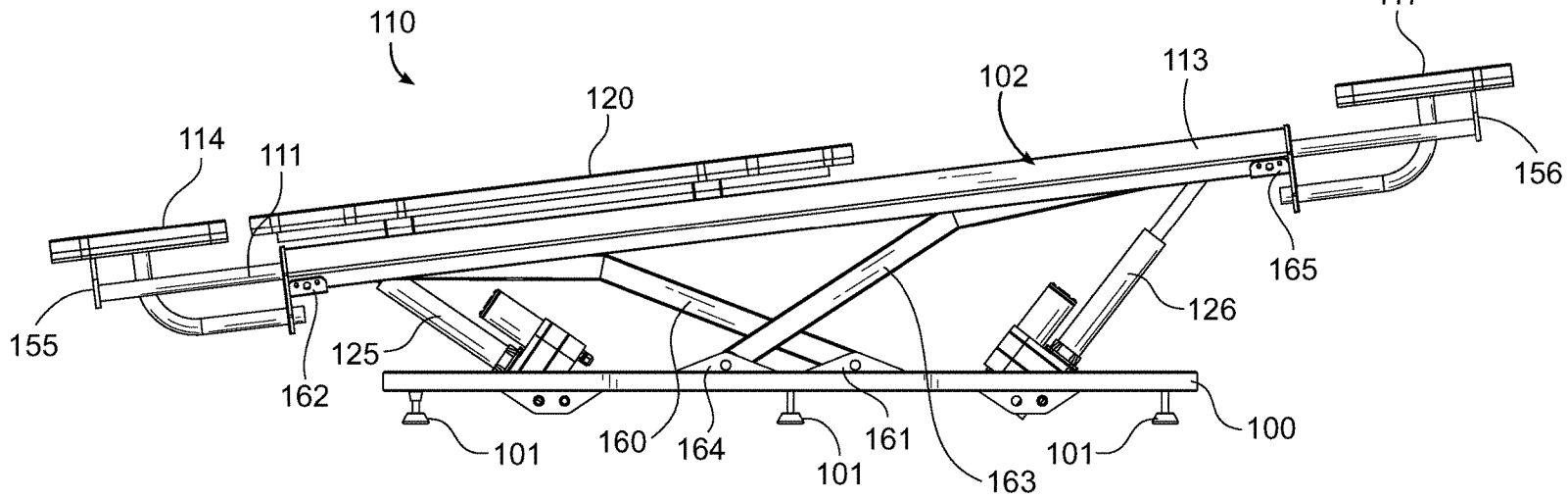
FIG. 16 is a side view of an adjustable exercise machine with the second end of its upper frame in a lifted position in accordance with an example embodiment.
Figure 17:
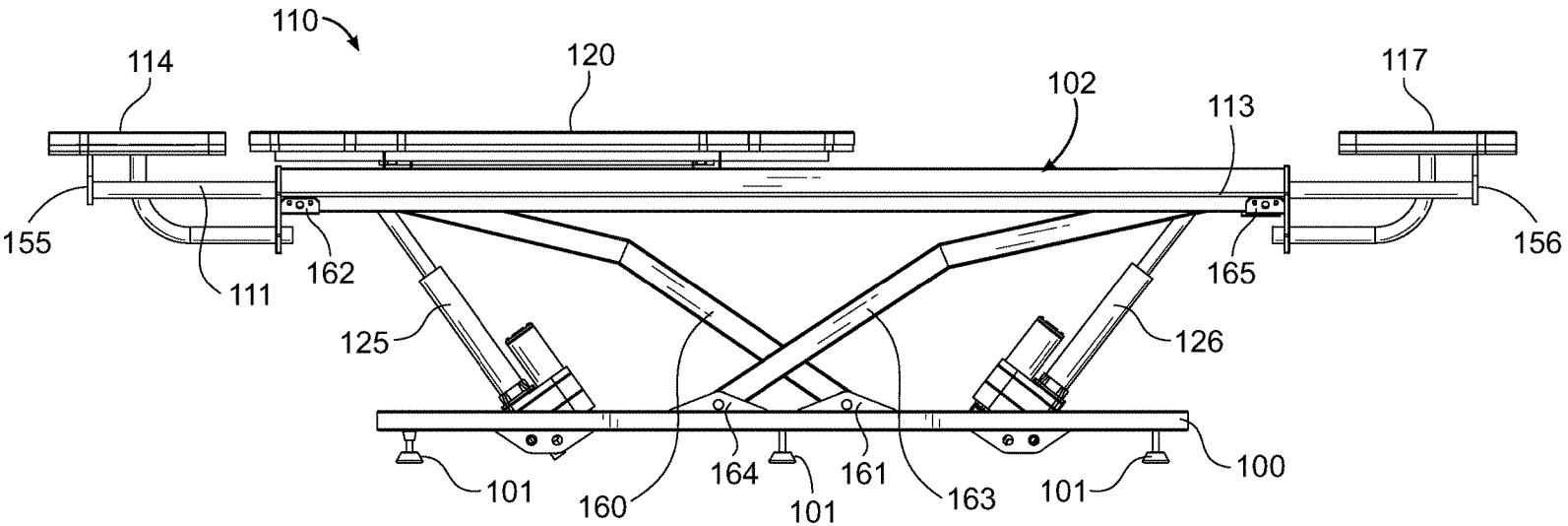
FIG. 17 is a side view of an adjustable exercise machine with the upper frame in a lifted position in accordance with an example embodiment.
Figure 18:
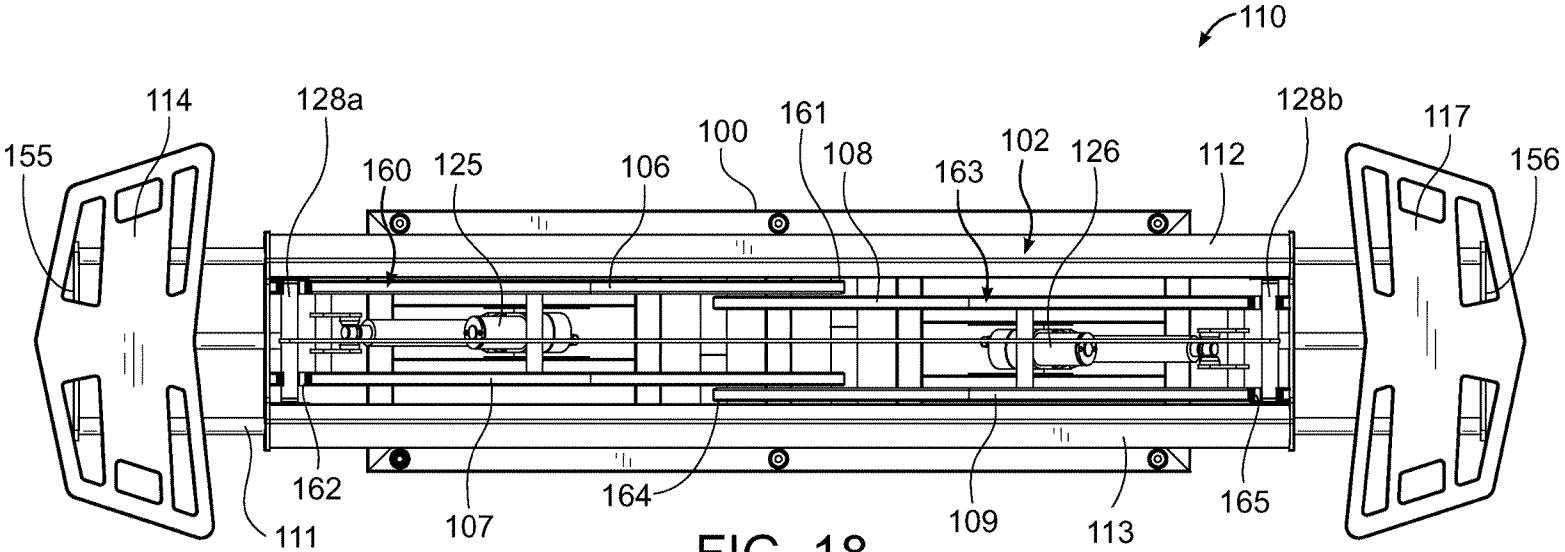
FIG. 18 is a top view of an adjustable exercise machine with the movable platform removed in accordance with an example embodiment.
Figure 21:
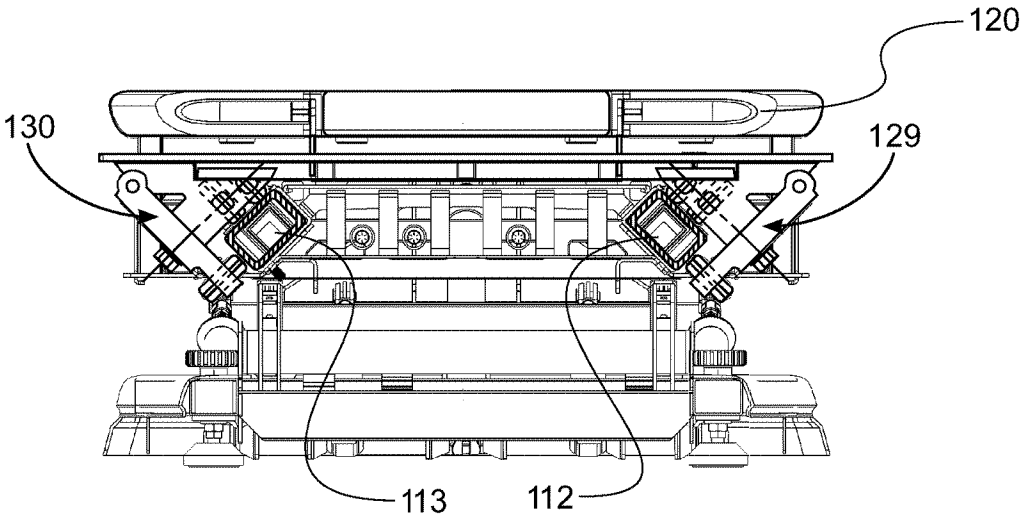
FIG. 21 is an end view of an adjustable exercise machine with trolley wheel assemblies in accordance with an example embodiment.

As best shown in FIGS. 15-17, a first actuator 125 (front actuator) is connected between the base 100 and the first lift support 160 such that the first end 155 of the upper frame 111 may be lifted or lowered with respect to the base 100. A second actuator 126 (back actuator) is connected between the base 100 and the second lift support 163 such that the second end 156 of the upper frame 111 may be lifted or lowered with respect to the base 100.

Figure 10A:
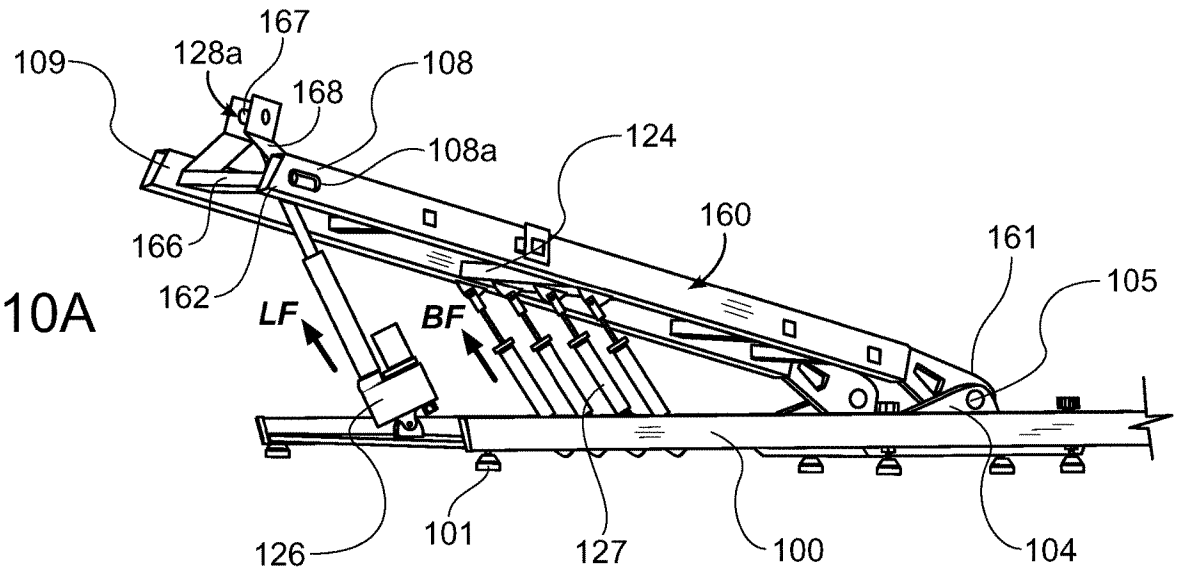
FIG. 10A is a side perspective view of a first lift support of an adjustable exercise machine in accordance with an example embodiment.

As shown in FIG. 10A, the first lift support 160 comprises a first end 161 and a second end 162. The first end 161 of the first lift support 160 may be connected at or near the mid-point of the base 100. The second end 162 of the first lift support 160 may be connected at or near the first end 155 of the upper frame 111.

The second lift support 163 similarly comprises a first end 164 and a second end 165. The first end 164 of the second lift support 163 may be connected at or near the mid-point of the base 100, adjacent to the first end 161 of the first lift support 160 such as shown in FIGS. 15-17. The second end 165 of the second lift support 163 may be connected at or near the second end 156 of the upper frame 111. In some embodiments, such as the exemplary embodiment shown in FIGS. 15-17, the first lift support 160 may cross the second lift support 163, with the first end 161 of the first lift support 160 being closer to the second end 156 of the upper frame 111 than the first end 164 of the second lift support 160.

Each of the lift supports 160, 163 may comprise a pair of distally-spaced arms 106, 107, 108, 109 and a lifting yoke 128*a*, 128*b*. In the exemplary embodiment shown in FIG. 10A, the first lift support 160 is illustrated as comprising a first arm 106 and a second arm 107 parallel to the first arm 106, with a lifting yoke 128*a* being connected between the distal ends of the first and second arms 106, 107 of the first lift support 160. Similarly, the second lift support 163 is illustrated as comprising a first arm 108 and a second arm 109 parallel to the first arm 108, with the lifting yoke 128*b* being connected between the distal ends of the first and second arms 108, 109 of the second lift support 163.

Various types of arms 106, 107, 108, 109 may be utilized. By way of example and without limitation, each of the arms 106, 107, 108, 109 may comprise a jib such as shown in the figures. In other embodiments, the arms 106, 107, 108, 109 may comprise other types of elongated members, such as beams or the like.

Figure 10B:
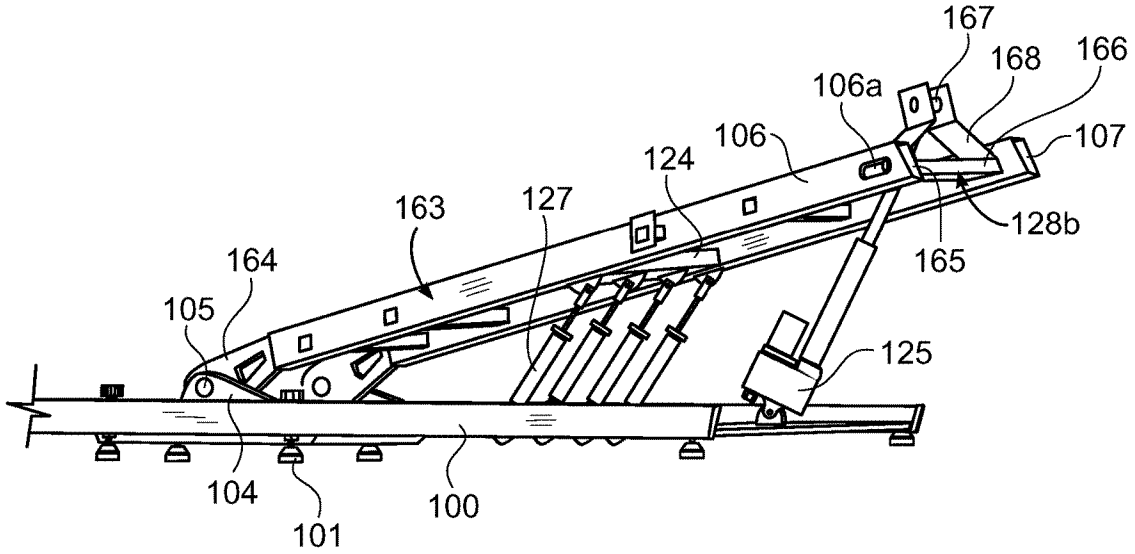
FIG. 10B is a side perspective view of a second lift support of an adjustable exercise machine in accordance with an example embodiment.

The lifting yokes 128*a*, 128*b* may each comprise a lower transverse member 166, an upper elongated member 167, and connecting members 168. The lower transverse member 166 may extend between the first and second arms 106, 107, 108, 109 of each lift support 160, 163 as shown in FIGS. 10A and 10B. The connecting members 168 may comprise angularly-extending members across which is connected the upper elongated member 167, with the upper elongated member 167 being connected to the upper frame 111.

The base 100 of the machine 110 comprises a lifting base with an elongated support structure. The structural elements comprising the support structure 100 may be substantially co-planar. The base 100 is adapted to be positioned upon and supported by a floor or other support surface that is preferably substantially horizontal. A plurality of adjustable leveling feet 101 are mounted to the base 100 to enable the base 100 to be leveled relative to the floor or other support surface and the exercise machine 110 to be securely supported thereon in a substantially horizontal plane in the event the floor or other support surface is not substantially horizontal or has surface imperfections that interfere with providing level support. Various types of leveling feet 101 are readily available and are suitable for this purpose.

A plurality of pivotable arms 106, 107, 108, 109 extend between the base 100 and the upper frame 111 of the exercise machine 110 preferably at or near front left, front right, back left, and back right locations relative to the front and back ends and lateral sides of the exercise machine 110. Only the front right arm 106 and back right arm 108 are visible in FIG. 1. The others are obscured by other elements of the example exercise machine 110 but can be seen in other figures, for example FIGS. 4-5 and 7-10. As described in further detail below, each arm 106, 107, 108, 109 comprises an elongated arm structure with a proximal pivoting end pivotably mounted to the base 100 and a distal lifting end pivotably mounted to the upper exercise support 111 of the exercise machine 110. The arms 106, 107, 108, 109 extend between the base 100 and the upper frame 111 substantially in alignment with and parallel to the longitudinal axis of the exercise machine 110.

The upper frame 111 of the machine 110 comprises a pair of elongated substantially parallel right and left rails 112, 113 that extend in the direction of and parallel to the longitudinal axis and lateral sides of the machine 110 for substantially the entire length of the machine 110. The upper frame 111 also comprises a stationary front end exercise platform 114 mounted at or near the front end of the exercise machine 110, a stationary back end exercise platform 117 mounted at or near the back end of the exercise machine 110, and a movable exercise platform 120 supported on the rails 112, 113 by a plurality of trolley wheel assemblies 129, 130 in a manner described in detail below. The trolley wheel assemblies 129, 130 are not readily visible in FIG. 1 but can be readily seen in other figures, including FIGS. 11-17. The movable platform 120 is supported on and guided by the rails 112, 113 for reciprocal sliding movement between the front and back end platforms 114, 117.

The upper frame 111 further comprises a biasing assembly 123. The biasing assembly 123 comprises a plurality of biasing members 121 and a plurality of biasing member selector knobs 122. The biasing members 121 are obscured in FIG. 1 by other elements of the exercise machine 110, but can be seen in other figures, for example in FIG. 3. A biasing member selector knob 122 is affixed to one end of each biasing member 121 and the other end of the biasing member 121 is affixed to a stationary component of the exercise machine 110. A user may select and removably engage any number of biasing member selector knobs 122 into knob retainers 151 on the back end of the movable platform 120 to establish a desired amount of resistance force opposing movement of the movable platform 120 for a particular exercise to be performed. The biasing assembly 123 enables an exerciser to selectively set a desired baseline level of resistance against movement of the movable platform 120 for a particular exercise to be performed.

In addition to the exercise platforms 114, 117, 120, the upper frame 111 comprises a plurality of handle assemblies 115, 116, 118, 119. A front right handle assembly 115 and a front left handle assembly 116 are mounted at or near the front end of the exercise machine 110 adjacent to the front end platform 114. Similarly, a back right handle assembly 118 and a back right handle assembly 119 are mounted at or near the back end of the machine 110 adjacent to the back end exercise platform 117.

Figure 2:
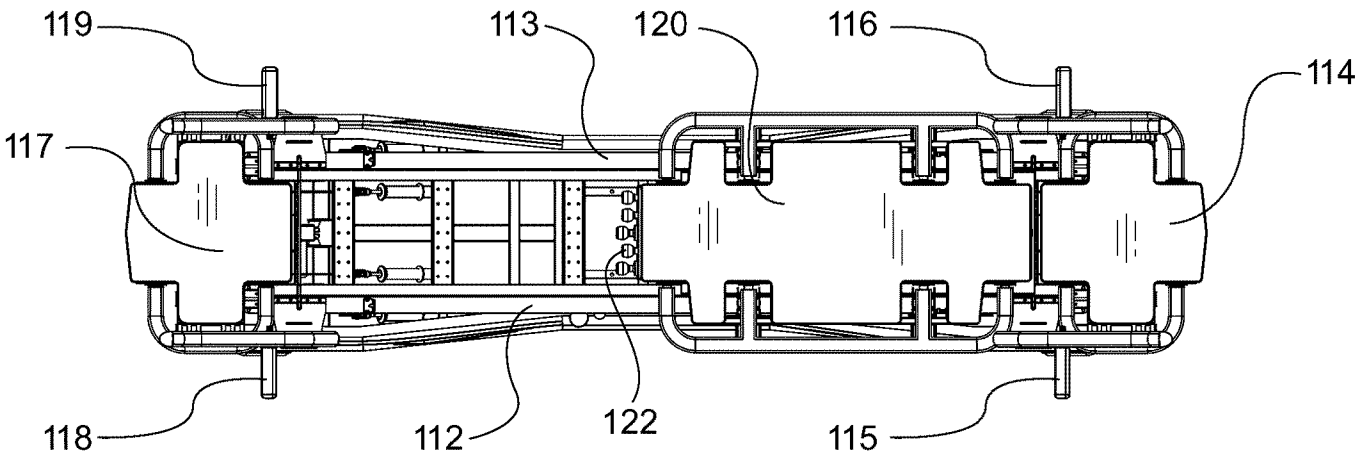
FIG. 2 is a top view of an adjustable exercise machine in accordance with an example embodiment.

Referring primarily to FIG. 2, a portion of the upper frame 111 of an example exercise machine 110 is illustrated, which obscures the view of the base 100 previously described. The pair of elongated substantially parallel rails 112, 113, i.e., right rail 112 and left rail 113, extends in alignment with the longitudinal axis of the exercise machine 110 substantially the entire length between the front end platform 114 and back end platform 117. The movable platform 120 is movably mounted on the rails 112, 113 and reciprocates along the rails 112, 113 substantially between the front and back end platforms 114, 117 at or near the proximal and distal ends of the exercise machine 110 in response to the exerciser's movements. Front right and left handle assemblies 115, 116 mounted adjacent to the front end platform 114 and back right and left handle assemblies 118, 119 mounted adjacent to the back end platform 117 provide grasping locations for an exerciser and facilitate the performance of exercises.

Figure 3:
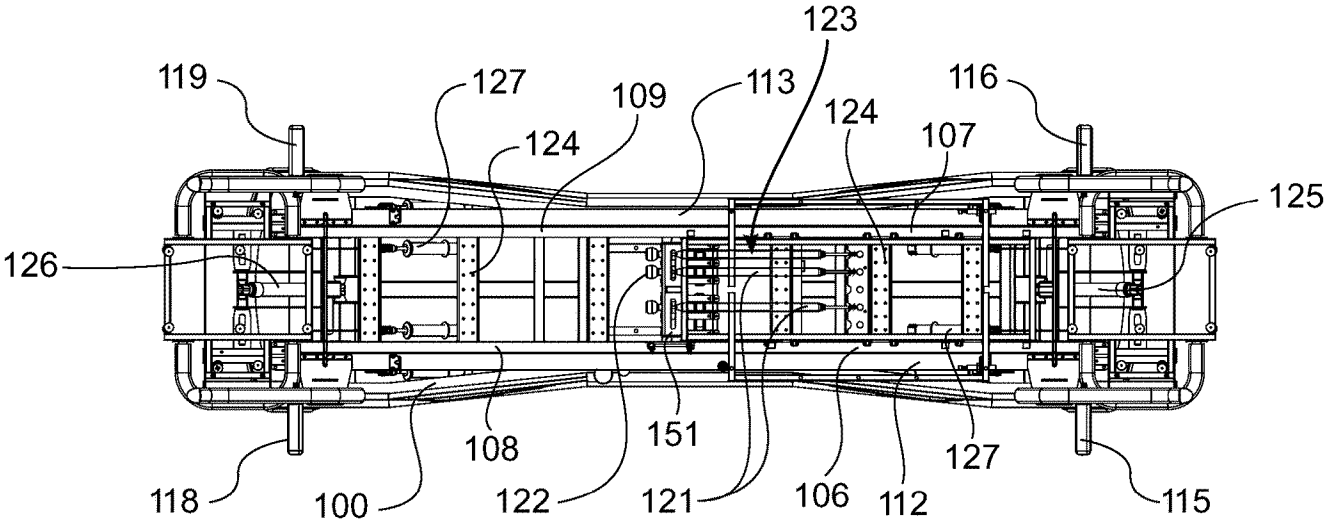
FIG. 3 is a bottom view of an adjustable exercise machine in accordance with an example embodiment.

Referring primarily to FIG. 3, the exercise platforms 114, 117, 120 of an example exercise machine 110 as described above have been removed and various internal components of the exercise machine 110 are visible. For positional reference, the front and back handle assemblies 115, 116, 118, 119 also are shown. As can be readily seen, the internal structural members and movable components of the exercise machine 110 preferably include one or more transverse structural members 124. The transverse structural members 124 extend substantially perpendicularly between the front pair of arms 106, 107 and the back pair of arms 108, 109. These help provide rigidity to the upper frame 111 of the exercise machine 110 as well as additional support for other components of the machine 110 and the weight of an exerciser. The connection between the transverse structural members and the front and back pairs of arms 106, 107, 108, 109 can be seen in greater detail in FIGS. 10A and 10B.

Another internal component is the biasing assembly 123 referred to previously. The biasing assembly 123 comprises a plurality of biasing members 121, a plurality of biasing member selector knobs 122, and a plurality of knob retainers 151 affixed to the back end of the movable platform 120. A knob selector is affixed to the first end of each of the plurality of biasing members 121. The opposite second ends of the biasing members 121 are affixed to a stationary component of the machine 110. The biasing member selector knobs 122 can be selectively engaged in the knob retainers 151 by an exerciser to selectively attach biasing members 121 to the movable platform 120 to apply a desired amount of resistance against sliding movement of the movable platform 120 on the rails 112, 113 as the exerciser exercises.

Other internal components include a plurality of shock absorbers 127. In a preferred arrangement, one or more shock absorbers 127 are mounted on each lateral side of the exercise machine 110 at or near the locations where the movable platform 120 reaches the end of its reciprocal range of motion at the stationary front and back end platforms 114, 117. Each shock absorber 127 is connected between a location on the base 100 of the exercise machine 110 and a location on a transverse structural member 124 that extends between and connects the front pair of arms 106, 107 or the back pair of arms 108, 109.

Alternatively, one or more shock absorbers 127 could be connected directly to one or more of the arms 106, 107, 108, 109. The visible portion of the base 100 can be seen in FIG. 3 below the exercise machine 110 components just described. The shock absorbers 127 nearest the front end of the exercise machine 110 preferably extend at a forward angle from the base to a transverse structural member 124 between arms 106, 107 while the shock absorbers 127 nearest the back end of the exercise machine 110 preferably extend at a rearward angle from the base 100 to a transverse structural member 124 between arms 108, 109. The angle at which the shock absorbers 127 extend may vary depending on the dimensions of the shock absorbers 127, the arms 106, 107, 108, 109, and the desired vertical range of motion of the arms 106, 107, 108, 109. The shock absorbers 127 are illustrated as comprising a compressed spring type but may comprise pneumatic, hydraulic, or other devices known for shock absorbent properties consistent with achieving the functionality and objectives described herein.

Still other internal components include a front actuator 125 and a back actuator 126. The front and back actuators 125, 126 may be independently operable so as to cause the front end and the back end of the exercise machine 110 to raise and lower as selected. This operation provides the ability to add a portion of the weight of an exerciser on the exercise machine 110 to the baseline resistance established by the biasing assembly 123 to achieve the benefits previously described and others.

The actuators 125, 126 may comprise linear-type actuators. The actuators 125, 126 may be controlled using suitable switches and electrical wiring mounted on the exercise machine 110 itself or by a suitable remote control transmitter and corresponding receiver mounted on the exercise machine 110. The front actuator 125 may be connected between the base 100 and the pair of front arms 106, 107 and the back actuator 126 may be connected between the base 100 and the pair of back arms 108, 109.

The front actuator 125 is shown connected with the pair of front arms 106, 107 in a manner to cause both front arms 106, 107 to raise and lower together and synchronously. Similarly, the back actuator 126 is connected with the pair of back arms 108, 109 in a manner to cause both back arms 108, 109 to raise and lower together and synchronously. The manner in which the front and back actuators 125, 126 are connected to the front and back arms 106, 107, 108, 109 respectively is described in greater detail below.

Figure 4:
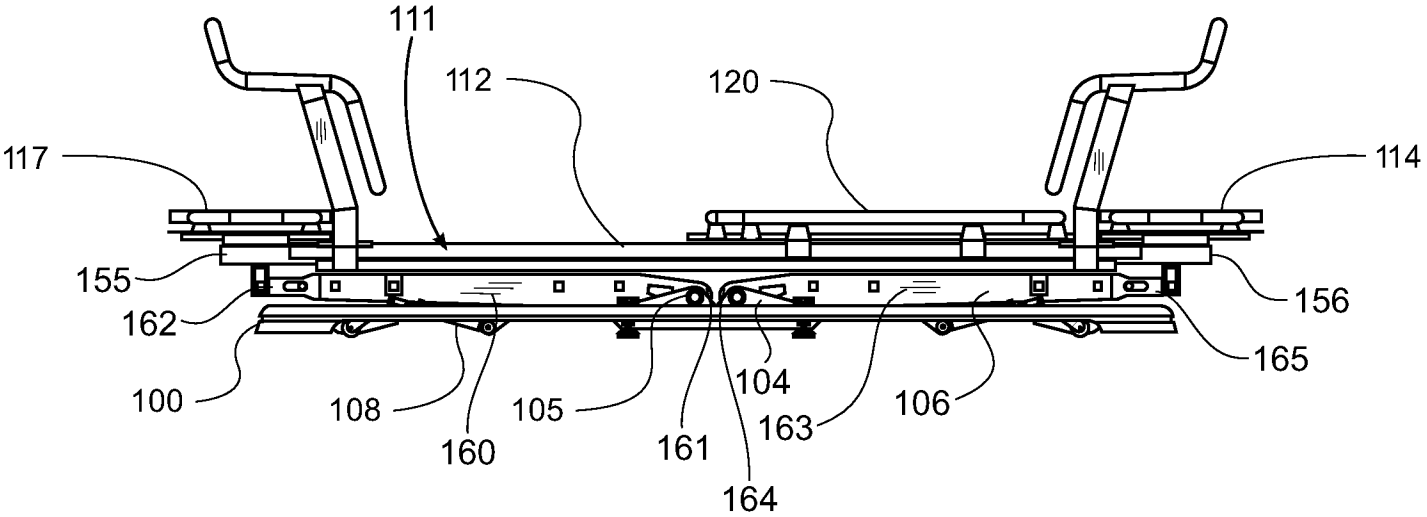
FIG. 4 is a side view of an adjustable exercise machine in accordance with an example embodiment.
Figure 5:
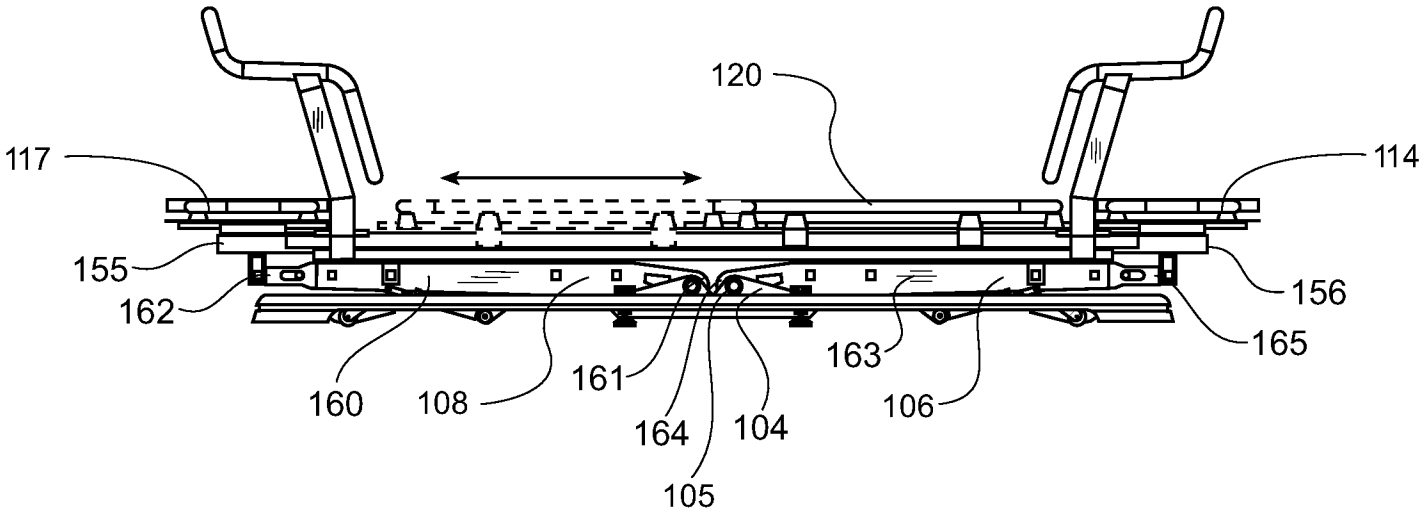
FIG. 5 is a side view of an adjustable exercise machine illustrating movement of the movable platform in accordance with an example embodiment.

Referring primarily to FIGS. 4 and 5, the front and back end platforms 114, 117 and the movable platform 120 of an exemplary embodiment of an exercise machine 110 are arranged in a common plane. Preferably, in a default or starting position of the exercise machine 110 the plane of the platforms is substantially horizontal. The movable platform 120 is slidable along substantially the length of the right rail 112 and left rail 113, which is obscured by the right rail 113, extending substantially the entire length between the front end platform 114 and back end platform 117 of the exercise machine 110. The reciprocal path of motion of the movable platform 120 between the front and back end platforms 114, 117 is indicated in FIG. 5 by the two-headed arrow and the position of the movable platform 120 near the back platform 117 is shown by dotted lines.

Also illustrated are front right and back right lifting arms 106, 108. Although not visible in FIGS. 4 and 5, front left and back left arms 107, 109 are arranged as a mirror image of the front and back right arms 106, 108 relative to the base 100. As described briefly above, each of the arms 106, 107, 108, 109 comprises an elongated arm with a proximal end pivotably connected to the base 100 and a distal end pivotably connected to an upper frame 111 of the front or back end of the exercise machine 110 in a manner described in detail below. Each of the arms 106, 107, 108, 109 extends in the direction of the longitudinal axis of the exercise machine 110 substantially parallel with each other and with the rails 112, 113, which also connect at their front and back longitudinal ends to structural members of the front and back ends of the machine 110.

A plurality of pivot bearing flanges 104 and bearings 105 are mounted on the base 100 of the exercise machine 110. Each of the bearing flanges 104 extends upwardly from the base 100. Each of the plurality of bearings 105 is seated in and extends laterally through a bearing flange 104 into an opening in a proximal end of an arm 106, 107, 108, 109, thus allowing the proximal end of the arm 106, 107, 108, 109 to be rotated or pivoted about the bearing 105 and the distal end of the arm 106, 107, 108, 109 to be pivoted upwardly and downwardly relative to the base 100.

In a preferred arrangement, a first bearing flange 104 and bearing 105 pair is mounted atop a right lateral side component of the base 100 approximately at and just forward of the mid-point of the longitudinal extent of the base 100. The first bearing flange 104 and bearing 105 pair connects with and engages the proximal end of the front right arm 106. Similarly, a second bearing flange 104 and bearing pair 105 is mounted atop the right lateral side component of the base 100 approximately at and just rearward of the mid-point of the longitudinal extent of the base 100 and adjacent to the first bearing flange 104 and bearing pair 105. The second bearing flange 104 and bearing 105 pair connects with and engages the proximal end of the back right arm 108. While not visible in the side views of FIGS. 4 and 5, it will be appreciated that similar third and fourth bearing flange 104 and bearing 105 pairs may be similarly mounted atop a left lateral side component of the base 100 and connect to and engage the proximal ends of the front left 107 and back left 109 arms.

When the proximal ends of the front right and front left arms 106, 107 are caused to pivot in unison relative to the base 100 in response to an actuator 125, the distal ends of the arms 106, 107 rotate upwardly or downwardly, depending on the direction of rotation of the proximal ends, and cause the front end of the exercise machine 110 to raise or lower accordingly relative to the elevation of the back end and the base 100 of the machine 110. This in turn slants or tilts the plane of the exercise platforms 114, 117 such that the front end platform 114 is elevated and slants down toward the movable platform 120, and the movable platform 120 is elevated and slants down toward the back end platform 117.

Similarly, when the proximal ends of the back right and back left arms 108, 109 are caused to pivot relative to the base 100 in unison in response to an actuator 126, the distal ends of the arms 108, 109 rotate upwardly or downwardly, depending on the direction of rotation of the proximal ends, and cause the back end of the exercise machine 110 to raise and lower accordingly relative to the elevation of the front end and the base 100 of the exercise machine 110. This in turn slants or tilts the plane of the exercise platforms 114, 117 so that the back platform 117 is elevated and slants down toward the movable platform 120, and the movable platform 120 is elevated and slants down toward the front platform 114. By causing both the front and back sets of lifting arms 106, 107, 108, 109 to raise or lower both the front and back ends of the exercise machine 110 by the same amount, the plane of the platforms 114, 117 can be raised or lowered relative to the elevation of the base 100 while remaining in a substantially horizontal plane.

Figure 6:
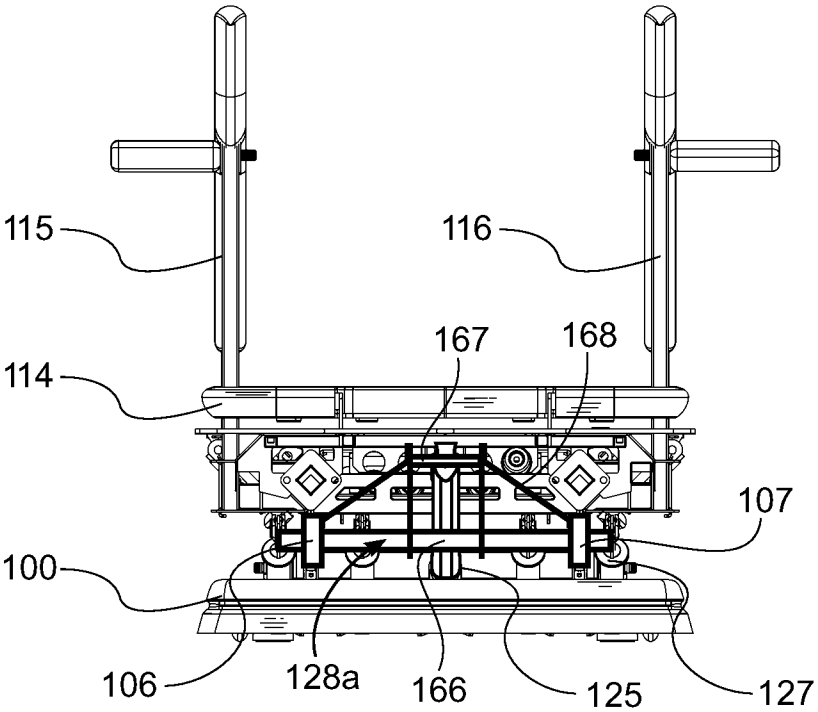
FIG. 6 is a front view of an adjustable exercise machine in accordance with an example embodiment.

Referring primarily to FIG. 6, the upper frame 111 of an example machine 110 includes a front platform 114 and front right and front left handle assemblies 115, 116. Each front handle assembly 115, 116 includes an elongated vertical member. Each front handle assembly 115, 116 is mounted at or near the lower end of the vertical member to a structural member of the front end of the exercise machine 110 at or near the right or left lateral side of the exercise machine 110 respectively and at or near the front end of the exercise machine 110 adjacent to the front end platform 114.

The upper frame 111 of the exercise machine 110 is supported at or near the front end of the machine 110 on the base 100 by at least one front actuator 125, the pair of front arm arms 106, 107, and a plurality of shock absorbers 127. A front lifting yoke 128*a* comprises a lower elongated member 166 and an upper elongated member 167, which extend in parallel with each other substantially perpendicularly to the longitudinal axis of the exercise machine 110. Connecting members 168 extend from the opposite ends of the lower member upwardly to the opposite ends of the upper member to connect the upper and lower members into a unitary yoke structure.

The lower member of the yoke 128 extends transversely and substantially perpendicularly between the front right arm 106 and front left arm 107 and is movably and rotatably affixed at its opposite ends to the front right arm 106 and front left arm 107 at or near their respective distal ends. The upper member is movably and rotatably affixed to the distal end of the front actuator 125. In practice, when the front actuator 125 is activated, a linear rod extends from an actuator body, thereby lifting the front yoke 128 and the distal ends of the front arm 106, 107 beams in unison and therefore elevating the front end of the exercise machine 110.

Figure 7:
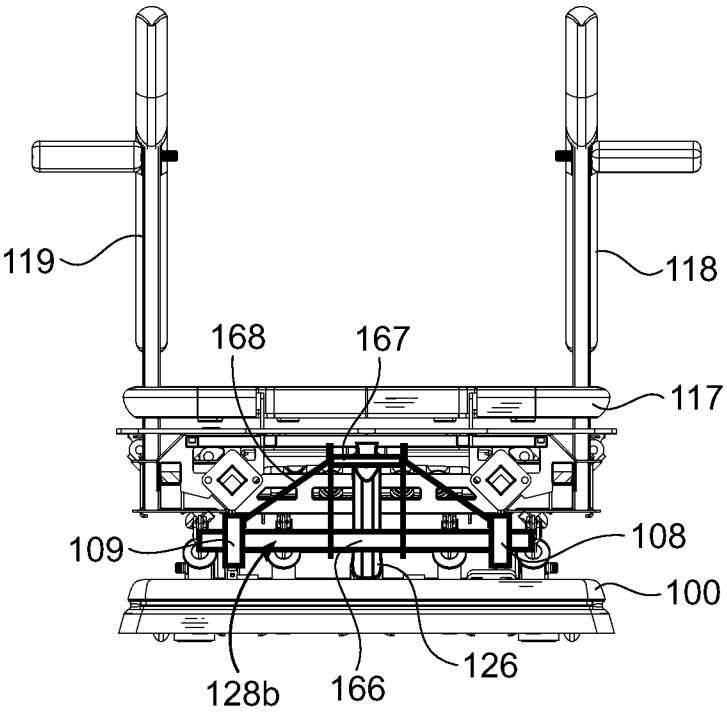
FIG. 7 is a back view of an adjustable exercise machine in accordance with an example embodiment.

Referring primarily to FIG. 7, the upper frame 111 of the example machine 110 includes a back end platform 117 and back right and back left handle assemblies 118, 119. Each back handle assembly 118, 119 includes an elongated vertical member. Each back handle assembly 118, 119 is mounted at or near the lower end of the vertical member to a structural member of the back end of the exercise machine 110 at or near the right or left lateral side of the machine 110 respectively and at or near the back end of the machine 110 adjacent to the back end platform 117.

The upper frame 111 of the example machine 110 is supported at or near the back end of the machine 110 on the base structure 100 in substantially the same manner as previously described with respect to the front end, i.e., by at least one back actuator 126, the pair of back arm arms 108, 109, and a plurality of shock absorbers 127. A back lifting yoke 128*b* is essentially identical to the front lifting yoke 128*a* described above and is connected between the distal ends of the back arms 108, 109 and the distal end of the back actuator 126 in the same manner as described above with respect to the front yoke 128, front arms 106, 107, and front actuator 125. Essentially identical to the description above, in practice, when the back actuator 126 is activated, a linear rod extends from the actuator body, thereby lifting the back yoke 128 and the distal ends of the back arm 108, 109 beams in unison and therefore elevating the back end of the exercise machine 110.

Figure 8:
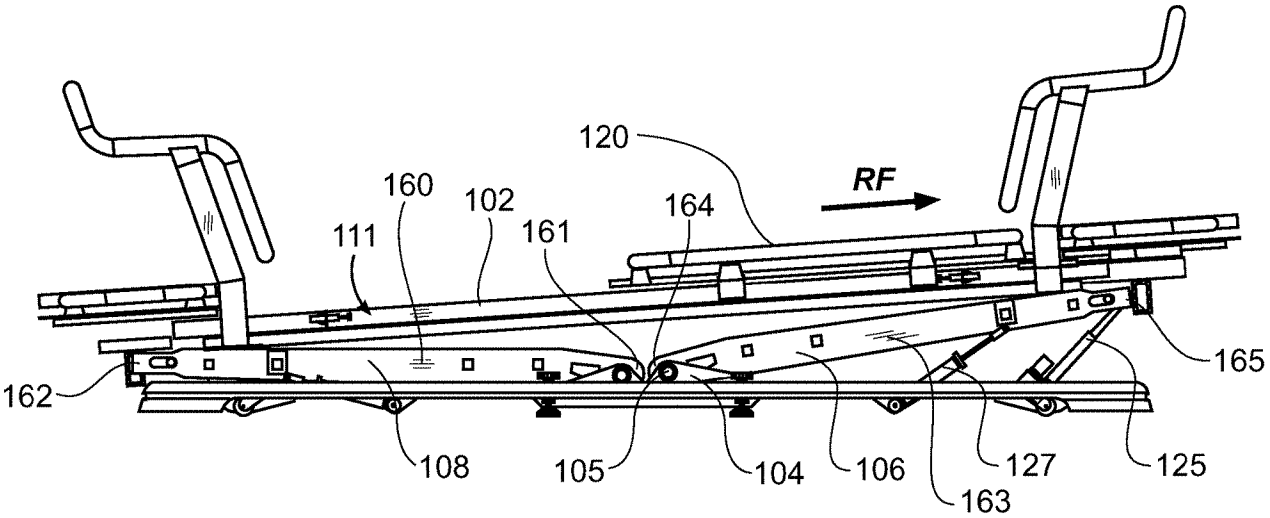
FIG. 8 is a side view of an adjustable exercise machine with its second end being lifted in accordance with an example embodiment.

Referring primarily to FIG. 8, an example exercise machine 110 is shown with the front end elevated relative to the lowered, default horizontal position. As previously described, but not shown in this figure, one or more biasing members 121 can be selectively and removably affixed between a stationary component of the exercise machine 110 structure and the movable platform 120 to create a resistance force "RF" biased toward the front end of the machine 110 as indicated by the arrow direction. In practice, an exerciser must exert sufficient force against the movable platform 120 in a direction substantially opposed to the resistance force RF to overcome the force and move the movable platform 120 towards the back end of the machine 110. The resistance force applied to the movable platform 120, and the exerciser's muscle force in the opposite direction sufficient to overcome the resistance force establishes the foundation for the resistance training level for an exercise routine.

As previously described, the front right arm 106 is movably connected to the base support structure 100 by means of a bearing flange 104 and arm pivot bearing 105. Although obscured by the front right arm 106 in this view, the front left arm 107 is movably connected to the base 100 in the same manner. In the position with the front end of the machine 110 elevated, it can be seen that the proximal end of the front right arm 106 has been rotated or pivoted in a counterclockwise direction about the bearing flange 104 and the distal end of the front right arm 106 has thus pivoted upwardly into an elevated position relative to the horizontal plane of the base 100. Due to the distal ends of the front right and front left arms 106, 107 being connected via the yoke 128, as previously described, the front left arm 107 functions in unison with the front right arm 106 and is in the same position as the front right arm 106 when the front end of the exercise machine 110 is elevated. Also in this position the plane of the exercise platforms 114, 117 has been tilted downwardly from the front end of the exercise machine 110 toward the back end of the exercise machine 110.

The back right arm 108 is a mirror image of the front right arm 106, and is movably affixed to the base 100 in the same manner as the front right arm 106. The back left arm 109, which is behind the back right arm 108 and is not visible in this view, also is movably connected to the base 100 in the same manner. It will be appreciated that with the front end of the exercise machine 110 elevated as shown and the back end of the exercise machine 110 in the lowered horizontal position, the back right and back left arms 108, 109 are not pivoted upwardly but remain in the substantially lowered default horizontal position. It will be further appreciated that by causing the proximal ends of the back right and back left arms 108, 109 to rotate about their arm pivot bearings 105 in a clock-wise direction, the distal ends of the back right and back left arms 108, 109 can be caused to pivot upwardly to elevate the back end of the exercise machine 110 in the same manner as described above with respect to the front right and front left arms 106, 107.

The lifting or elevating of the front end of the machine 110 is achieved by the combined operation of the front actuator 125 and a plurality of shock absorbers 127. As previously mentioned, the front actuator 125 may comprise a linear-type actuator with one proximal end movably connected to a stationary component of the base 100 and the opposite distal end movably connected to the upper transverse member 167 of the front lifting yoke 128*a*. The plurality of shock absorbers 127 have a first proximal end movably connected to a stationary component of the base 100 and a second distal end movably connected to a transverse structural support member 124 extending between the front right and front left arms 106, 107. For example, the proximal ends of the actuator 125 and shock absorbers 127 can be movably attached to the base 100 in the same manner as described for the proximal ends of the arms 106, 107, i.e., via bearing flanges 104 and pivot bearings 105. The distal ends of the shock absorbers 127 can be movably attached to the transverse structural member 124 in the same manner.

In operation, the distal end of the front actuator 125 starts in a retracted state and the distal ends of the shock absorbers 127 start in a compressed state. In this state, the front right and front left arms 106, 107 are in a lowered substantially horizontal position, the front end of the exercise machine 110 is in a lowered substantially horizontal position, and the exercise platforms 114, 117 are in a lowered, substantially horizontal position relative to the base 100.

Activating the front actuator 125 causes the distal end of the actuator 125 to extend linearly outward from the actuator body, which in turn causes the proximal ends of the front right and front left arms 106, 107 to pivot counter-clockwise around their pivot bearings 105 and the distal ends of the front right and front left arms 106, 107 to rotate upwardly, elevating the front end of the exercise machine 110. As the arms 106, 107 rotate upwardly, the distal ends of the shock absorbers 127 also become extended and the compressive force from the shock absorbers 127 applied to the transverse structural member 124 through their distal ends generates an additional upward force and reduces the lifting force required from the actuator 125.

Although not separately shown, it will be appreciated that lifting or elevating the back end of the machine 110 is achieved by the combined operation of the back actuator 126 and a plurality of back shock absorbers 127 in the same manner as described in the preceding paragraphs with respect to the front end of the machine 110.

Figure 9:
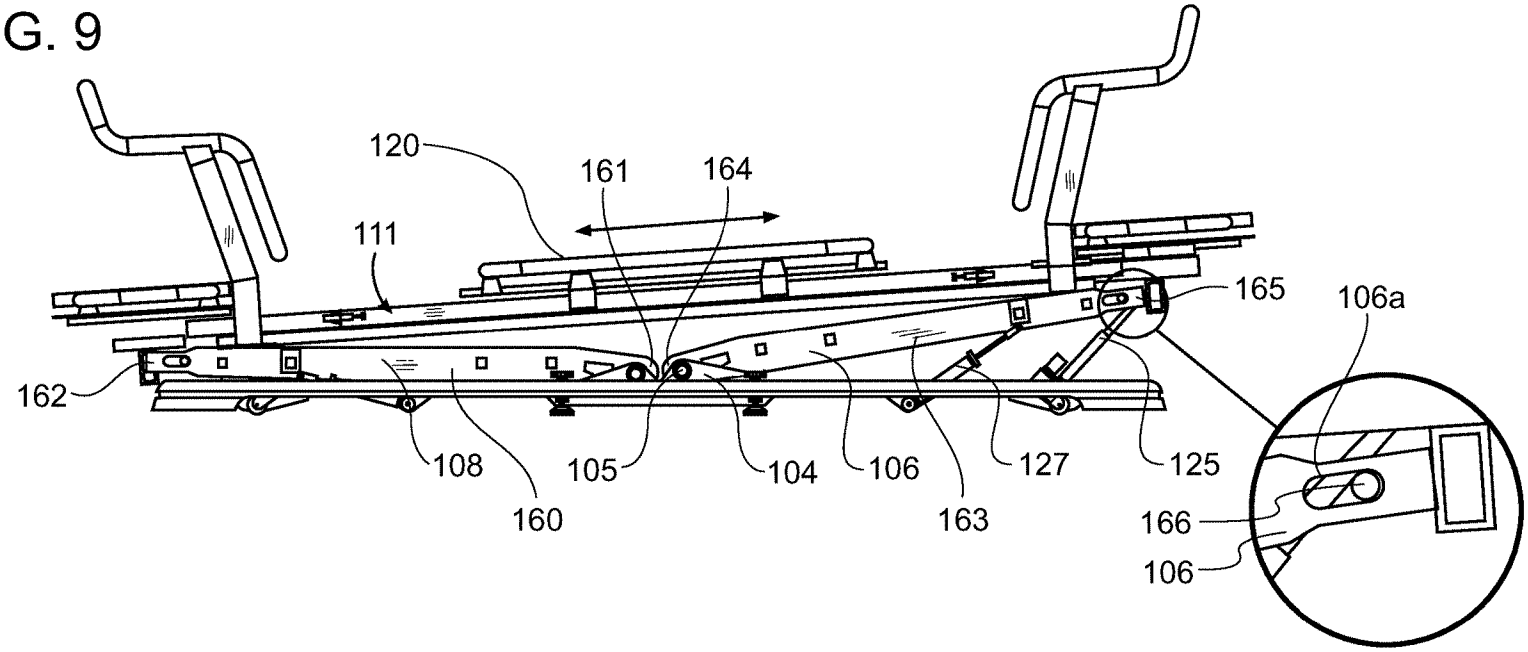
FIG. 9 is a side view of an adjustable exercise machine with its second end being lifted in accordance with an example embodiment.

Referring primarily to FIG. 9, the movable platform 120 of an exemplary exercise machine 110 is repositioned from the position shown in FIG. 8 by rolling or sliding the movable platform 120 along the rails 112, 113 on a plurality of previously identified trolley wheel assemblies 129, 130, which are described in detail below. As indicated by the bidirectional arrow, the movable platform 120 is movable reciprocally in either direction between the front end and the back end of the exercise machine 110 substantially the entire length between the front and back end platforms 114, 117.

The inset of FIG. 9 illustrates an enlarged view of the raised distal end of the front right arm 106. At or near the distal end is an elongated retaining slot 106*a* that extends substantially in the longitudinal direction of the arm 106. The lower transverse member 166 of the front lifting yoke 128*a* described above protrudes transversely through the elongated slot 106*a* and acts as a lifting pin for the arm 106. It will be appreciated that although not visible in the side view of FIG. 9, the distal end of the front left arm 107 has the same elongated retaining slot 106*a* and that the lower transverse member 166 of the front yoke 128*a* also extends transversely through that slot. Thus, when the distal end of the front actuator 125, which is movably connected to the lower transverse member 166 of the yoke 128*a*, extends outwardly, the distal ends of the arms 106, 107 are caused to move in unison.

It also will be appreciated that as the distal end of the front actuator 125 extends outwardly and elevates the distal ends of the front right and front left arms 106, 107 from their initial horizontal position, the transverse lifting pin of the lifting yoke 128*a* slides forward in the elongated retainer slots 106*a* toward the distal ends of the arms 106, 107. Similarly, as the distal end of the actuator 125 retracts, the transverse lifting pin slides in the slots 106*a* back toward the proximal ends of the arms 106, 107. This sliding movement prevents binding and interference between the lifting pin and the arms 106, 107. Thus in a preferred arrangement, the elongated retaining slots 106*a* have a central longitudinal axis aligned with the central longitudinal axis of the arms 106, 107, and the slots 106*a* are of sufficient length to allow the full range of vertical travel desired for the distal ends of the arms 106, 107 without interference and binding between the lifting pin of the lifting yoke 128 and the arms 106, 107.

Although not shown in FIGS. 8 and 9, it will be appreciated that the distal ends of the back right and back left arms 108, 109 have the same elongated retaining slots as the distal ends of the front right and front left arms 106, 107 and that the lower transverse member of the back lifting yoke 128*b* extends through those slots and acts as a lifting pin for the back arms 108, 109 in the same manner as described above with respect to the front arms 106, 107. It further will be appreciated that when the distal end of the back actuator 126 is extended and retracted, the lifting pin of the back lifting yoke 128*b* slides in the retainer slots of the back arms 108, 109 in the same manner and achieves the same functions as described above with respect to the front lifting yoke and arms 106, 107.

Referring primarily to FIGS. 10A and 10B, the example exercise machine 110 comprises a pair of lift supports 160, 163, one dedicated to the front end of the machine 110 (FIG. 10B) and one to the back end of the exercise machine 110 (FIG. 10A). It is preferred that the lift support 160, 163 at one end of the exercise machine 110 is substantially a mirror image of the lift support 160, 163 at the opposite end of the exercise machine 110. Thus, the following description of the components and functioning of the lift support 163 for the back end 156 of the exercise machine 110 may be considered equally as a description of the components and functioning of the lift support 160 for the front end 155 of the exercise machine 110, and vice versa.

With that in mind and referring to FIG. 10A, the lift support 163 for the back end 156 of the exercise machine 110 comprises an elongated back right arm 108 and an elongated back left arm 109 which extend in the direction of the longitudinal axis of the exercise machine 110 toward the back end of the exercise machine 110 substantially in parallel with each other and with the lateral sides of the exercise machine 110. The back right and back left arms 108, 109 preferably are mirror images of each other. The proximal ends of the back arms 108, 109 are movably connected to opposite lateral sides of the base 100 by bearing flanges 104 and arm pivot bearings 105 as previously described. A lifting yoke 128 is movably connected between the distal ends of the arms 108, 109 as previously described. A back actuator 126 has a lower proximal end rotatably connected to the base 100 and a linearly extendible distal end connected to the lifting yoke 128 in the manner previously described. The actuator 126 is operable to increase or decrease the elevation of the distal ends of the arms 108, 109 by extending or retracting a piston rod rotatably connected at its distal end to the lifting yoke 128 in the manner previously described.

The back end lifting structure further comprises a plurality of shock absorbers 127. The lower proximal ends of the shock absorbers 127 are rotatably connected to the base 100, and the extendable rods comprising the upper distal ends of the shock absorbers 127 are rotatably connected to a transverse structural member 124 extending between and affixed at opposed ends to the arms 108, 109. As previously described, the lower proximal and upper distal ends of the shock absorbers 127 may be rotatably connected to the base 100 and to the transverse structural member 124 respectively via bearing flanges 104 and pivot bearings 105 in substantially the same manner as the lower proximal end of the back actuator 126 is pivotably connected to the base 100. It should be noted that while the plurality of shock absorbers 127 may be hydraulic, pneumatic, spring-type or another type consistent with the operation and functions described herein, they may also comprise spring-based shock absorbers 127 with piston travel lengths of sufficient dimension so that an internal or external coil spring remains at least partially compressed when the arms 108, 109 are positioned at their maximum preferred elevation.

The spring-based shock absorbers 127 serve three key functions. First, the total compressive force produced by the plurality of springs produces a sufficient arm lifting force to counteract some or all of the weight of the upper frame 111 and an exerciser. The residual continuous force rating of the shock absorber 127 springs, even at full extension of the shock absorber 127 pistons, also reduces the lifting force required to be generated by the actuator 126. Therefore, the combination of the springs and the linear actuator 126 reduces the continuous force rating that would otherwise be required of a linear actuator to lift the upper frame 111 of the exercise machine 110 without the assistance of the spring-based shock absorbers 127. This is a commercially valuable innovation that substantially reduces the production cost of the exercise machine 110.

Second, the shock absorbers 127 are connected to the base 100 at their lower proximal ends and to the transverse structural member 124 at their distal ends. The transverse structural member 124 extends substantially perpendicularly to the longitudinal axis of the exercise machine 110 between the arms 108, 109. The spring force from the shock absorbers 127 is thus distributed across the transverse structural member 124 perpendicularly to the longitudinal axis of the machine 110. This arrangement minimizes the torsional forces that would otherwise be present when only one actuator 126 is used for lifting the distal ends of the arms 108, 109. Cancelling or at least substantially controlling the torsional forces relative to the longitudinal axis of the lift supports 160, 163 is an important function of the shock absorbers 127 as it provides a stabilized exercising plane for an exerciser regardless of the angle of elevation of the exercise machine 110.

Third, the use of spring-based shock absorbers 127 provides for more rapid changes in elevation of the exercise machine 110. This function is important so that the positioning of the exercise machine 110 can be changed quickly to facilitate the transition between different exercises of an exercise routine without stopping for repositioning. It will be appreciated that the speed of the linear actuator's 126 extension and retraction of a shock absorber 127 frequently corresponds inversely to the continuous force rating of the shock absorber 127. In other words, at a given voltage rating, the speed rating will decrease as the force increases. The use of spring-based shock absorbers 127 reduces the load rating requirement for the actuator 126, thereby allowing a higher speed actuator 126 to be used in place of a slow speed, high force-rated actuator 126 that would otherwise be required if spring-based shock absorbers 127 were not used.

C. Trolley Wheel Assemblies

It will be appreciated that linearly reciprocating resistance-based exercise machine 110*s*, such as a Pilates apparatus or rowing machine, generally comprise a movable platform 120 that moves along guide rails 112, 113 that are substantially aligned with the longitudinal axis of the exercise machine 110. The movable platform 120 may ride on a plurality of wheels attached to the underside of the movable platform 120. The primary function of the wheels is to reduce friction on the movable platform 120 as it reciprocates over its intended range of motion on a single plane. However, the plurality of wheels is not intended to and is not able to minimize or counteract lateral or uplift loads exerted on the movable platform 120 during exercise.

Referring primarily to FIG. 19, in the example exercise machine 110 described herein, the movable platform 120 reciprocates along the right and left parallel rails 112, 113 substantially the entire length between the front 114 and back 117 end platforms of the machine 110 on an improved platform rolling system comprising a plurality of multi-wheel trolley assemblies 129, 130. The movable platform 120, rails 112, 113, and trolley assemblies 129, 130 comprise a substantial portion of the upper frame 111 or assembly of the exercise machine 110, which is supported on the base 100. The improved multi-wheel trolley assemblies 129, 130 function to minimize or counteract lateral or uplift loads exerted on the movable platform 120 as it reciprocates on the rails 112, 113 during exercise by positioning multiple wheels 134 in rolling engagement with at least first and second substantially perpendicular surfaces of the rails 112, 113 as described in detail below.

In an exemplary arrangement two right trolley assemblies 129 are spaced apart longitudinally along the right lateral side of the movable platform 120 and two left trolley assemblies 130 are spaced apart longitudinally along the left lateral side of the movable platform 120. The pair of left trolley assemblies 130 are not visible in FIG. 19, but can be seen in other figures, such as FIGS. 13-16. The arrangement of the right and left trolley assemblies 129, 130 around the right and left lateral sides of the movable platform 120 is symmetrical and provides balanced support for the movable platform 120. The right and left trolley assemblies 129, 130 are substantially identical such that a description of one suffices as a description of each of them. Although two trolley assemblies 129, 130 per lateral side of the movable platform 120 are described in connection with the exemplary exercise machine 110 in the figures, it is understood that more or fewer trolley assemblies 129, 130 could be employed and the number of such assemblies is not intended to be limiting.

Referring primarily to FIGS. 20A and 20B, a pair of right multi-wheel trolley assemblies 129 is mounted to the underside of the movable platform 120 of an exemplary exercise machine 110 longitudinally spaced from each other and adjacent the right lateral side of the movable platform 120. Although not visible, a pair of left multi-wheel trolley assemblies 130 is similarly mounted to the underside of the movable platform 120 adjacent the left lateral side of the movable platform 120 in the same manner and arranged in the same way. More specifically, FIG. 12A is a view of the exercise machine 110 from the back end. As such, the back platform 117 can be seen in the foreground relative to the movable platform 120 and the pair of right trolley assemblies 129 can be seen mounted to the underside of the movable platform 120 adjacent to its right lateral side.

Referring more specifically to FIG. 20B, an enlargement of the circled portion of FIG. 20A is shown in inset with additional details of the right trolley assemblies 129 illustrated. Additional details of the trolley assemblies 129, 130 can also be seen in FIGS. 21-24. The trolley assemblies 129, 130 comprise a novel wheel configuration that provides for gravitational, uplift and lateral load support in at least two substantially perpendicular planes. Each trolley assembly generally comprises a mounting member 131, a clamp arm 132, at least one clamp wheel 133, a clamp fastener 135, and a pair of load wheels 134.

The mounting member 131 may be constructed as a substantially A-shaped angled frame structure having first and second legs. The angle between the first and second legs is selected to orient at least two sets of wheels 133, 134 in rolling engagement with at least first and second substantially perpendicular surfaces of a rail 112, 113 as will become clear. The first leg of the frame is affixed to the underside of the movable platform 120 with the leg extending substantially transversely to the longitudinal axis of the movable platform 120. The second leg extends at a downward angle from the underside of the movable platform 120 and outwardly toward the lateral edge of the movable platform 120. In an exemplary embodiment, the downward angle at which the second leg extends is approximately the same as the angle of a first surface 112*a* of the rail 112, relative to the underside of the movable platform 120, with which the load wheels 134 of the assembly 129, 130 are to maintain rolling engagement.

The clamp arm 132 comprises an elongated structure having a first end and a second end. The first end of the clamp arm 132 is pivotably connected at or near the outer extent of the first leg of the mounting member 131 such that the second end of the clamp arm 132 can be pivoted inwardly beneath the underside of the movable platform 120 toward the rail 112, 113 with which rolling engagement is to be maintained. In an exemplary embodiment, the clamp arm 132 and the second leg of the mounting member 131 are shaped, dimensioned, and arranged so that when the clamp arm 132 is pivoted inward it is able to slide over the outer extent of the second leg with the second end of the clamp arm 132 extending through and slightly beyond the outer extent of the second leg.

At least one clamp wheel 133 is rotatably mounted at or near the second end of the clamp arm 132 with the axis of rotation of the wheel 133 substantially coaxial with the longitudinal axis of the clamp arm 132. The clamp wheel 133 may be mounted for rotation at or near the second end of the clamp arm 132 by a suitable bearing mounted on an axle stub formed on a flange or other surface at or near the second end of the clamp arm 132. With this arrangement, as the clamp arm 132 is pivoted inward and slides over the outer extent of the second leg of the mounting member 131, the clamp wheel 133 pivots into rolling engagement with the second surface 112*b* of the rail 112 with which rolling engagement is to be maintained. Preferably, at this point, the longitudinal axis of the clamp arm 132 is substantially perpendicular with the longitudinal axis of the second leg.

An elongated axle having an inner end and an outer end is positioned and supported within the second leg of the mounting member 131. The pair of spaced apart load wheels 134 is rotatably mounted on the axle at or near its inner end in rolling engagement with the first surface 112*a* of the rail 112. Preferably the axle extends within the second leg substantially coaxially with its longitudinal axis. In this arrangement, the axis of rotation of the load wheels 134 in rolling engagement with the first surface 112*a* of the rail is substantially perpendicular with the axis of rotation of the clamp wheel 133 in rolling engagement with the second surface 112*b* of the rail. The outer end of the axle extends through the second leg, beyond its outer extent, and through an opening in a face of the clamp arm 132, where it is exposed. The exposed outer end may be threaded. The clamp fastener 135, which may comprise, for example, a typical hex nut, is threaded onto the exposed outer end of the axle and tightened to secure the clamp arm 132 to the mounting member 131. The clamp fastener 135 also provides a degree of adjustability to the movable platform 120 and trolley assembly 129, 130 as described in greater detail below.

Referring primarily to FIGS. 21-25, a pair of right trolley assemblies 129 and a pair of left trolley assemblies 130 are adapted to be mounted to the underside of the movable platform 120. The right and left trolley assemblies 129, 130 are movably clamped to the right rail 112 and the left rail 113 respectively and support the movable platform 120 on the rails 112, 113 for reciprocal rolling or sliding movement between the front and back end platforms 114, 117 of the exercise machine 110. The right and left rails 112, 113 are substantially parallel to each other and each has a substantially rectangular cross-section with the longitudinal axis of the major sectional dimension rotated to an approximate forty five degree angle towards the central longitudinal axis of the exercise machine 110. In this orientation, each rail 112, 113 has a respective first sloped upper lateral surface 112*a*, 113*a* and a respective second sloped lower lateral surface 112*b*, 113*b*. The upper and lower surfaces 112*a*, 112*b*, 113*a*, 113*b* may be adjacent and substantially perpendicular. The load wheels 134 of the trolley assemblies 129, 130 are maintained in rolling engagement with the first upper surfaces 112*a*, 113*a* of the rails 112, 113 and the clamp wheels 133 of the trolley assemblies 129, 130 are maintained in rolling engagement with the second lower surfaces 112*b*, 113*b* of the rails 112, 113.

It should be noted that the cross-sections of the rails 112, 113 are not limited to rectangular, and may be of any geometric cross-section so long as two adjacent lateral sides of each of the opposed rails 112, 113 form a sloped upper lateral surface 112*a*, 113*a* for rolling engagement by the plurality of load wheels 134, and a sloped lower lateral surface 112*b*, 113*b* for rolling engagement by one or more clamp wheels 134. In an exemplary embodiment, these adjacent surfaces will be substantially perpendicular to each other. It should also be noted that although a specific number and arrangement of clamp and load wheels 133, 134 have been identified in connection with the description of an example embodiment, the specific number and arrangement such wheels 133, 134 is not considered limiting and may be changed consistent with achieving the functions and objectives described herein.

Figure 22:
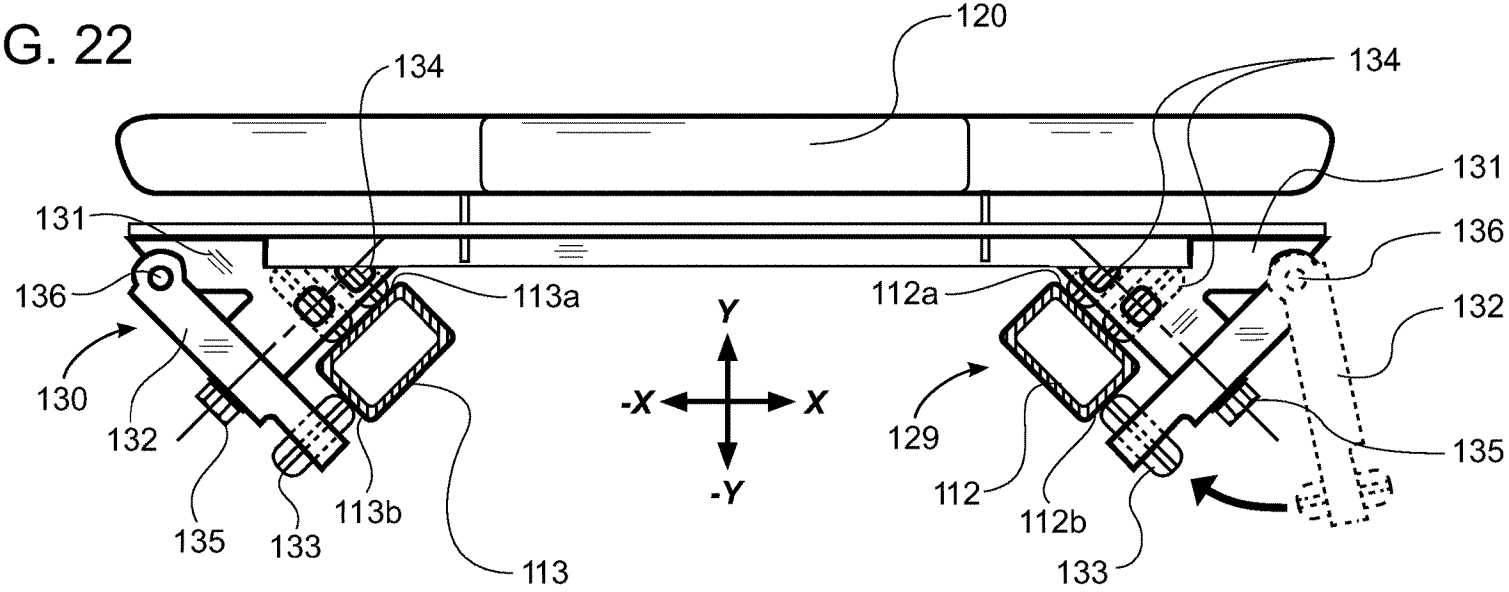
FIG. 22 is an end view of a movable platform of an adjustable exercise machine with trolley wheel assemblies in accordance with an example embodiment.
Figure 23A:
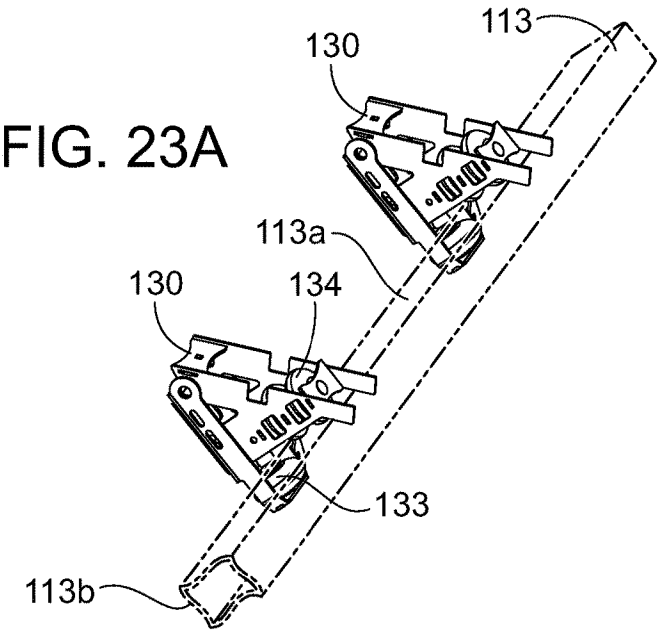
FIG. 23A is a first perspective view of the interconnection between trolley wheel assemblies and a rail of an adjustable exercise machine in accordance with an example embodiment.
Figure 23B:
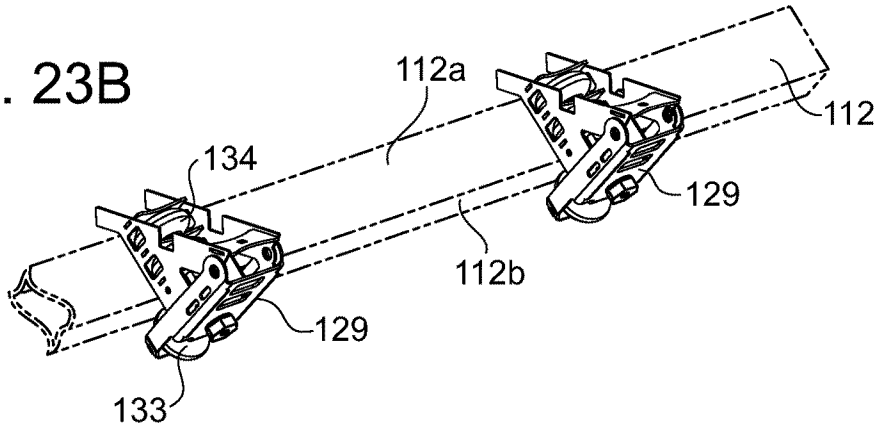
FIG. 23B is a second perspective view of the interconnection between trolley wheel assemblies and a rail of an adjustable exercise machine in accordance with an example embodiment.
Figure 24:
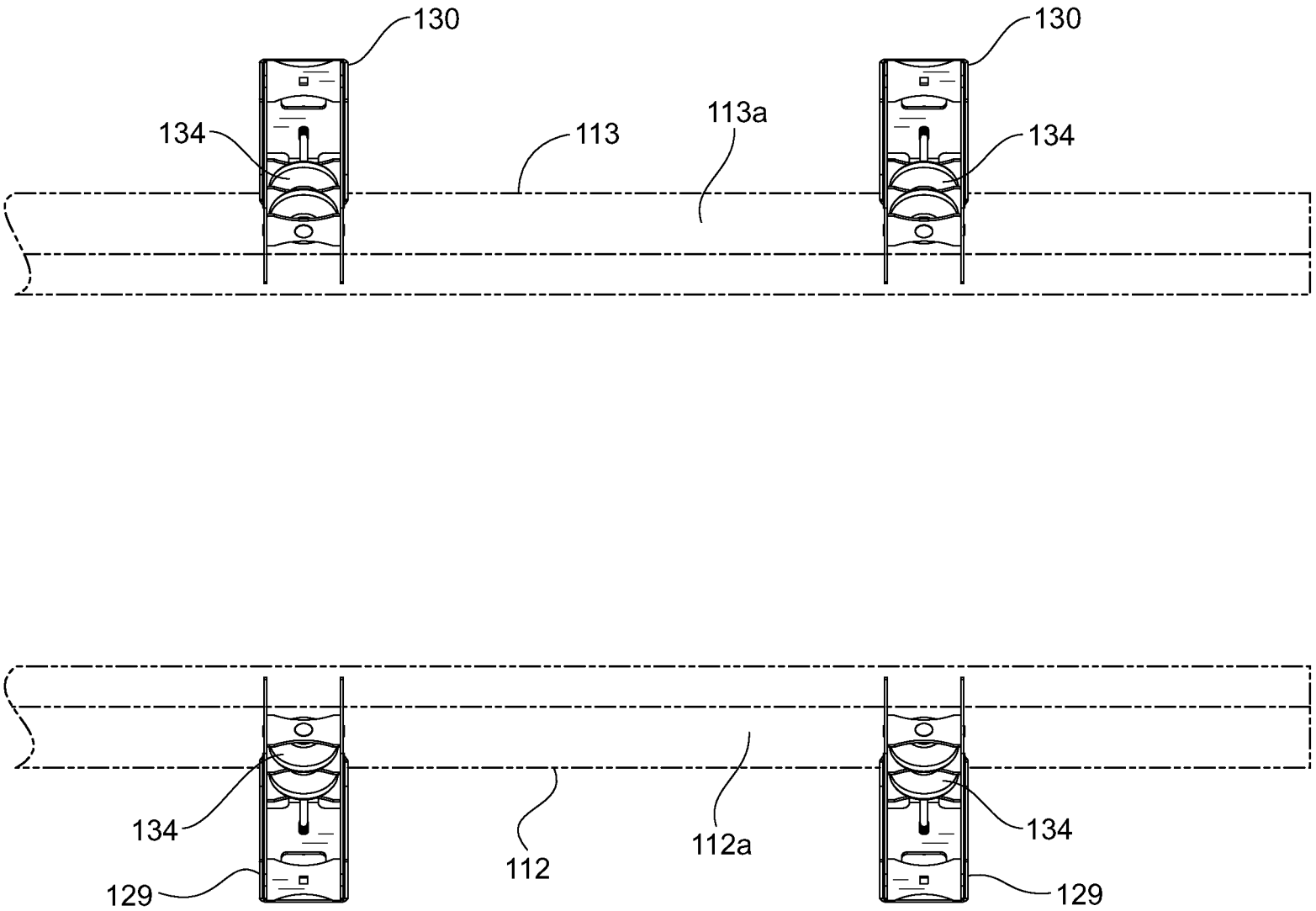
FIG. 24 is a third perspective view of the interconnection between trolley wheel assemblies and a rail of an adjustable exercise machine in accordance with an example embodiment.
Figure 25:
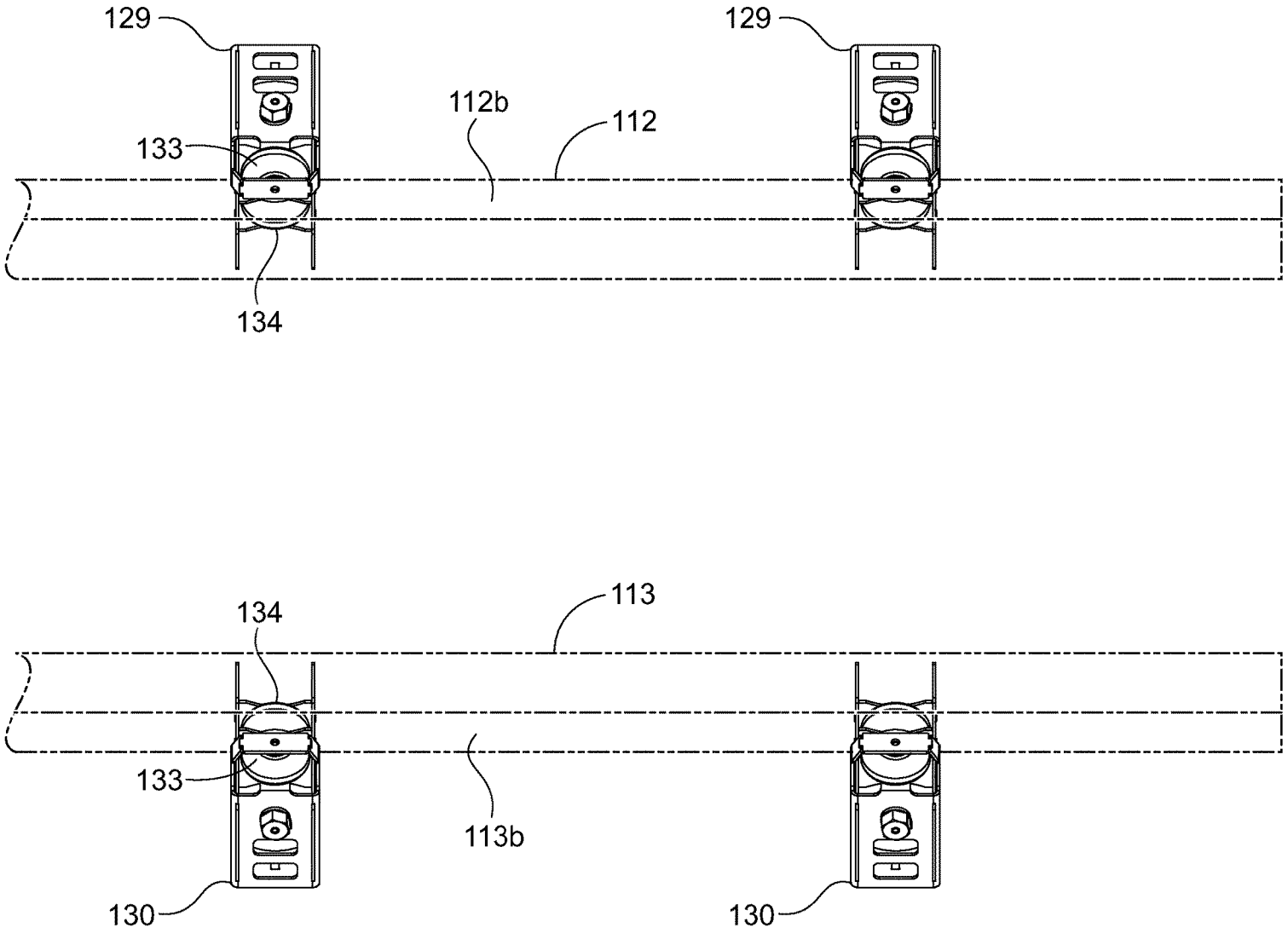
FIG. 25 is a fourth perspective view of the interconnection between trolley wheel assemblies and a rail of an adjustable exercise machine in accordance with an example embodiment.

Referring primarily to FIG. 22, two axes substantially perpendicular to each other and to the longitudinal axes of the rails 113, 114 and the exercise machine 110 are shown with double headed arrows as positive and negative X and Y axes. Using these for reference, one of the right side trolley assemblies 129 is mounted to the underside of the movable platform 120 adjacent the right (X) lateral side of the movable platform 120 and is adapted to move along the right rail 112. Similarly, one of the left side trolley assemblies 130 is mounted to the underside of the movable platform 120 adjacent the left (−X) lateral side and is adapted to move along the left rail 113. For efficiency, the components of the left side trolley assembly 130 are shown but not specifically referred to in the following description since they are substantially identical to and mirror images of the right side trolley assembly components.

Referring then primarily to the right side trolley assembly 129, the assembly 129 is mounted to the underside of the movable platform 120 via a mounting member 131. The two load wheels 134 are rotatably affixed to the inner end of the axle, which has a central axis indicated by the dashed centerline, and are in rolling engagement with the upper sloped surface 112*a* of rail 112. The outer end of the axle extends through the pivotable clamp arm 132 and terminates into the clamp fastener 135. The clamp wheel 133 is rotatably attached to an end of the clamp arm 132 adjacent to and in rolling engagement with the lower sloped surface 112*b* of the rail 112. The opposite end of the clamp arm 132 is rotatably attached to the mounting member 131 by a clamp hinge 136. As shown by the dashed outline of the clamp arm 132, the clamp arm 132 may be rotated towards the lateral sides of the exercise machine 110 for purposes of installing and removing the movable platform 120 assembly from the rails 112, 113, and/or for adjusting the vertical and lateral compression of the wheels 133, 134 against the rail surfaces 112*a*, 112*b*, 113*a*, 113*b*.

The unique and novel trolley system of the example exercise machine 110 thus provides for the self-centering of the movable platform 120 between the rails 112, 113 as the clamp arm 132 and clamp wheel 133 just described apply an upward force in the Y direction against the lower sloped surface 112*b*, 113*b* of the rail 112, 113 as the clamp fastener 135 is tightened. Concurrently, the tightening of the clamp fastener 135 applies a downward force through the load wheels 134 against the upper adjacent sloped surface 112*a*, 113*a* of the rail 112, 113 in a −Y direction. Further tightening of the clamp fastener 135 effectively reduces the vertical dimension between the load and clamp wheels 133, 134, causing the movable platform 120 to move laterally in the X direction. Similarly, by tightening the clamp fastener 135 of the trolley assembly 130 on the left side of the exercise machine 110, the movable platform 120 can be caused to move towards the left side in the −X direction. With the clamp fasteners 135 on the opposite right and left sides tightened equally, all lateral play in the −X and X directions is completely removed, and all vertical movement of the wheels against the rails 112, 113 in the Y and −Y directions is completely removed, thereby limiting the movable platform 120 to movement only along an axis parallel to the rails 112, 113.

Further, with the clamp wheels 133 of the right and left trolley assemblies 129, 130 positioned below the lateral corners of the rails 112, 113 in engagement with the lower sloped surfaces 112*a*, 113*a* of the rails 112, 113, the movable platform 120 will resist uplift forces that are either intentionally or inadvertently exerted upon the movable platform 120. The increased stability of the movable platform 120 relative to the rails 112, 113 is an important and novel feature that increases safety and, importantly, exerciser confidence in use of the exercise machine 110.

D. Travel Limit Decelerators

A persistent problem with exercise machines 110 with movable platforms 120, especially those which incorporate a biasing force against the movable platform 120, is that when exercisers dismount the movable platform 120 when it is at a position located between the allowable travel limits the movable platform 120 will immediately respond to the biasing force and violently slam against the mechanical limit stops at one end of the machine 110. This continual violent contact between the movable platform 120 and exercise machine 110 structure causes undue wear and damage to the exercise machine 110 that shortens mean time between failure and increases maintenance costs.

Figure 26A:
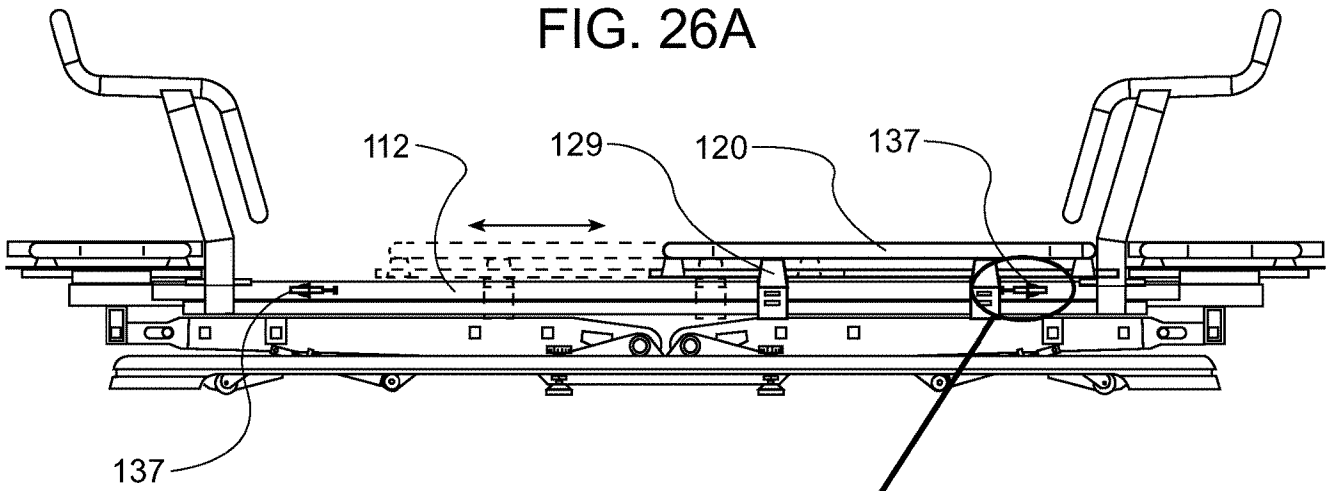
FIG. 26A is a side view of an adjustable exercise machine including a travel limit decelerator in accordance with an example embodiment.
Figure 26B:
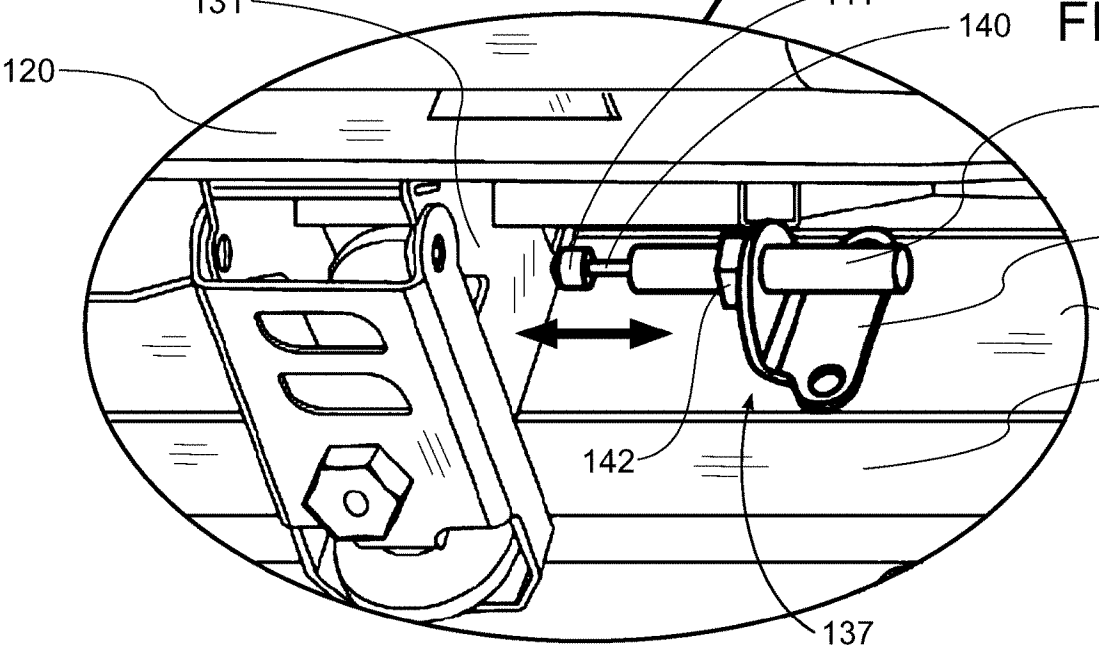
FIG. 26B is a perspective view of a travel limit decelerator in use on an adjustable exercise machine in accordance with an example embodiment.
Figure 27:
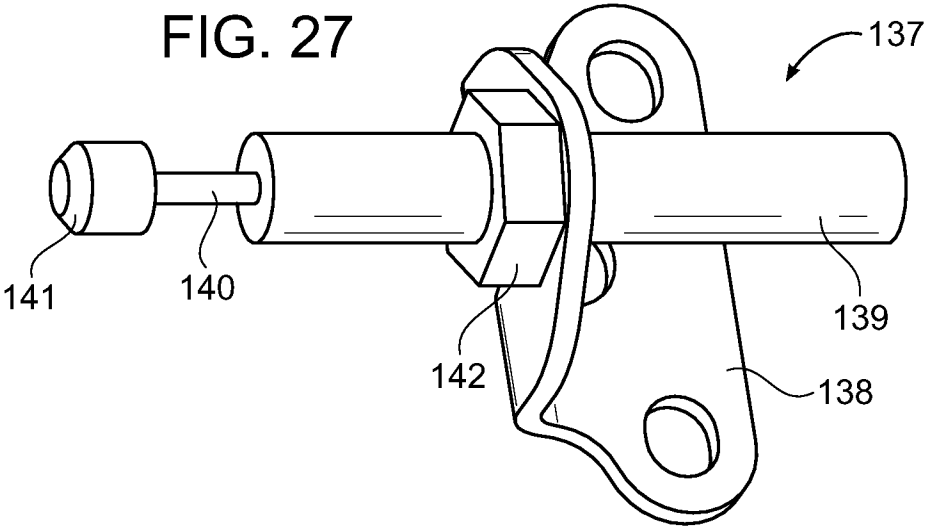
FIG. 27 is a perspective view of a travel limit decelerator of an adjustable exercise machine in accordance with an example embodiment.
Figure 29:
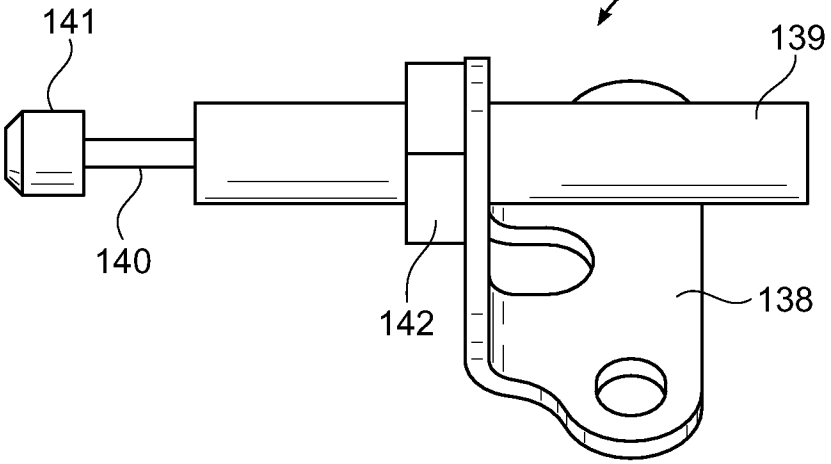
FIG. 29 is a side view of a travel limit decelerator of an adjustable exercise machine in accordance with an example embodiment.
Figure 28:
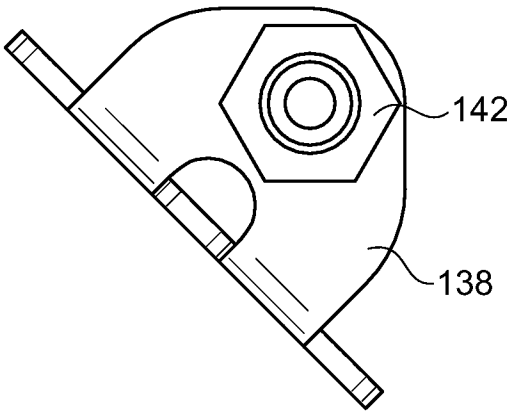
FIG. 28 is an end view of a travel limit decelerator of an adjustable exercise machine in accordance with an example embodiment.

Referring primarily to FIG. 26A, an example exercise machine 110 with a movable platform 120 and a plurality of movable platform travel limit decelerators 137 is illustrated. The movable platform travel limit decelerators 137 constitute a novel means of minimizing damage to the example exercise machine 110 and/or the movable platform 120 under the circumstances just described. More specifically, the travel limit decelerators 137 provide for a rapid deceleration of the movable platform 120. The travel limit decelerators 137 thus provide a more precise and smooth method of stopping the movable platform 120 as compared to the use of resilient members, such as rubber bumpers, which provide a more violent deceleration, and which ultimately wear away from repeated impact and require frequent replacement.

In the example exercise machine 110, the travel limit decelerators 137 are mounted to one or both of the substantially opposite ends of one or more of the rails 112, 113 such that they will engage with a structural component of the movable platform 120, for example a surface of one of the trolley assemblies 129, 130 as the movable platform 120 reaches its permissible limit of travel so that the movable platform 120 can be brought to a smooth, gentle, non-damaging stop at the travel limit.

Referring primarily to FIGS. 26B and 27-29, close up details of one of the example travel limit decelerators 137 are shown in connection with a corresponding trolley assembly 129, 130 and alone in several different perspectives. The travel limit decelerator 137 is connected to a surface of a rail 112, 113, for example the upper sloping surface 112*a* of right rail 112, via a mount 138 at a longitudinal location along the rail 112 to engage the movable platform 120 as it approaches or reaches the desired limit of travel of the movable platform 120. The travel limit decelerator comprises a decelerator body 139 with a shaft 140 and decelerator plunger 141. The decelerator body 139 is attached to the mount 138, for example via a mounting flange with the shaft 140 and plunger 141 extending outwardly in the direction of the trolley assembly 129, 130 so as to engage the assembly as the movable platform 120 approaches the desired limit of travel. The movable platform 120 and preferably a fixed structural component thereof, such as the trolley mounting member 131, move at a velocity in the direction of the deceleration limiter 137, and upon engaging the deceleration plunger 141 just described, begin to compress the plunger 141 and shaft 140 into the decelerator body.

The decelerator body may comprise a spring and/or a fluid displacement cylinder similar in function to a spring-based or fluid based shock absorber. Various types of decelerating and/or movement damping devices are commercially available and the particular type of travel limit decelerator 137 described herein is not meant to be limiting.

An adjustment mechanism 142 may be provided to change the longitudinal position of the decelerator body 139, plunger 141, and shaft 140 on the rail 112, 113 so as to engage the component of the movable platform 120 slightly farther or nearer to the desired limit of travel. An exemplary adjustment mechanism 142 will not require disconnecting the travel limit decelerator 137 from the rail 112, 113 surface. For example, the adjustment mechanism 142 may comprise a locking nut or nuts through which the decelerator body 139 passes longitudinally. With the nut loosened, the decelerator body 139 can slide longitudinally to bring the shaft 140 and plunger 141 nearer to or further from the desired point of travel limit. Tightening the nut can then lock the decelerator body 139 in place.

The novel exercise machine 110 as described above may comprise one or more travel limit decelerators 137 at a first travel limit position at or near first ends of the rails 112, 113 at which the movable platform 120 would engage the travel limit with a force exerted by at least a biasing member such as a biasing member 121 affixed between the stationary structure of the exercise machine 110 and the movable platform 120. Further, one or more travel limit decelerators 137 may be affixed at a second travel limit position at substantially opposite ends of the rails 112, 113 wherein the movable platform 120 would engage the second travel limit decelerators 137 with a force exerted by an exerciser's movement of the movable platform 120 towards the second end of the exercise machine 110.

It will be appreciated that neither the number nor specific locations of the travel limit decelerators 137 is intended to be limiting. Rather, one or more travel limit decelerators 137 may be used. It will further be appreciated that travel limit decelerators 137 may be located at either or both ends of one rail 112, 113, such as right rail 112 or left rail 113, and/or at either or both ends of both rails 112, 113 as desired or required by particular applications.

E. Operation of Preferred Embodiment

In use, an exerciser or instructor may first adjust the tilt and/or level of the exercise machine 110 by selectively lifting or lowering the front end 155 and/or rear end 156 of the upper frame 111 with respect to the base 100. The respective ends 155, 156 of the upper frame 111 may be raised or lowered by selective activation of front and/or back actuators 125, 126, with the front actuator 125 being operable to lift or lower the first end 155 of the upper frame 111 and the back actuator 126 being operable to lift or lower the second end 156 of the upper frame 111 with respect to the base.

The manner in which the actuators 125, 126 are activated to extend or retract may vary in different embodiments. By way of example, controls may be positioned on or near the exercise machine 110 which allow selective extension or retraction of either or both of the actuators 125, 126. In other embodiments, an exerciser or instructor may use a remote control or control mounted on the example exercise machine 110 to activate the front and/or back actuators 125, 126 and to adjust the vertical positions of the front and/or back ends and the inclination of the exercise machine 110 as desired or appropriate for an exercise or exercises to be performed. An exerciser or instructor may also select one or more biasing member selector knobs 122 and connect them to the movable platform 120 to apply a desired amount of biasing force to the movable platform 120.

Figure 11:
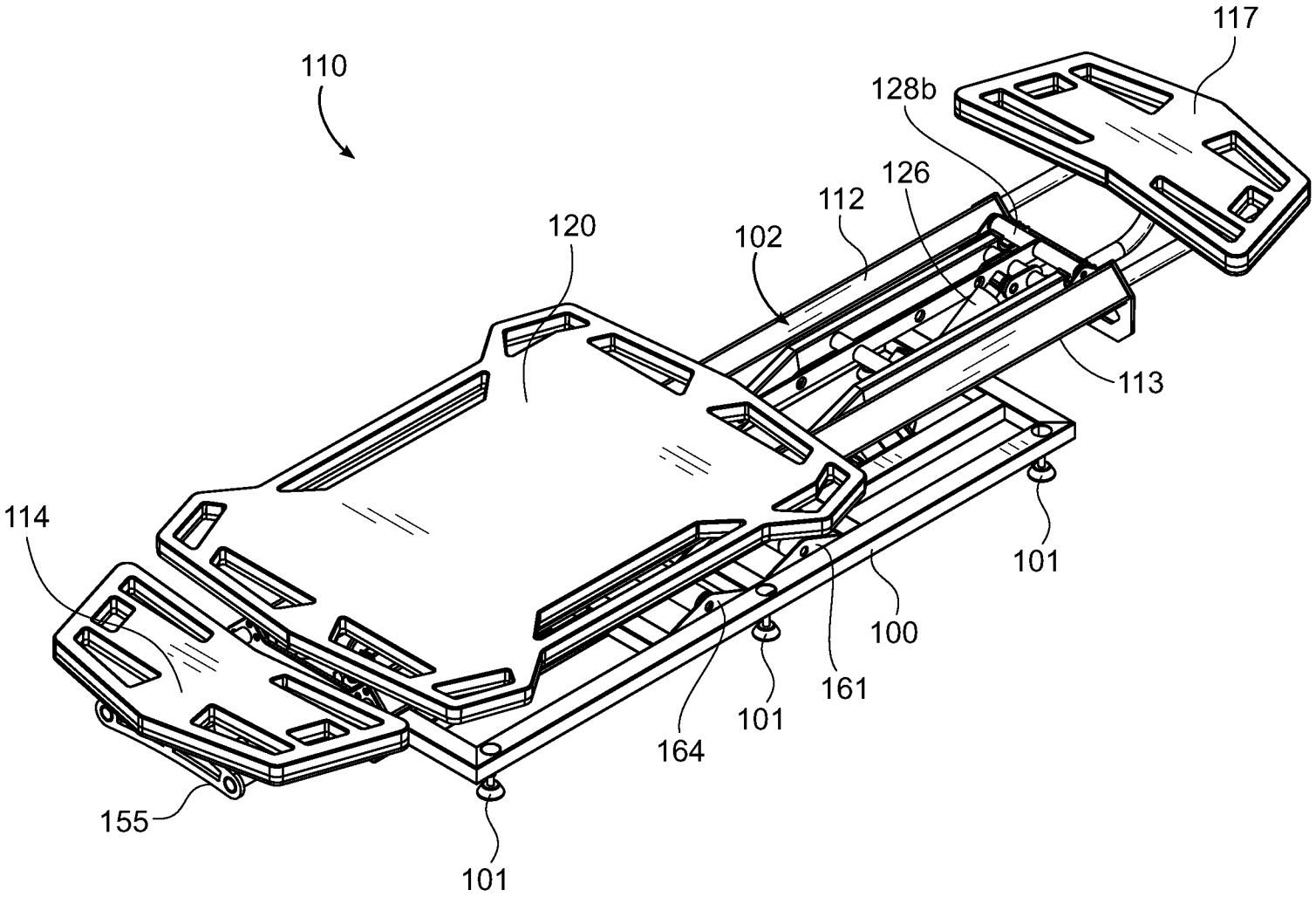
FIG. 11 is an upper perspective view of an adjustable exercise machine with the upper frame in a lowered position in accordance with an example embodiment.
Figure 14:
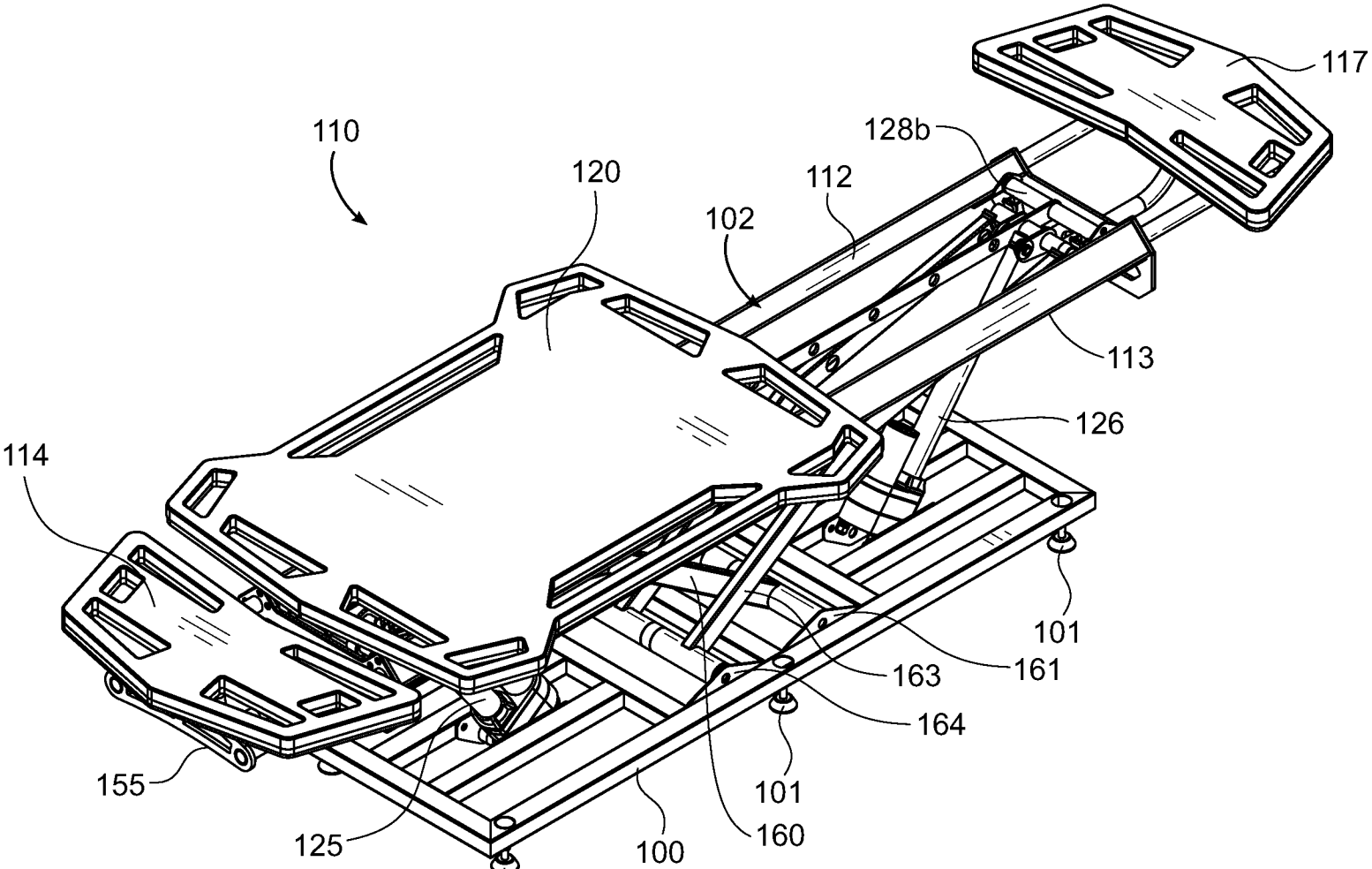
FIG. 14 is an upper perspective view of an adjustable exercise machine with both ends of its upper frame in a lifted position in accordance with an example embodiment.

Utilizing the front and back actuators 125, 126, an exerciser or instructor may adjust the exercise machine 110 between at least four configurations. As shown in FIG. 11, the exercise machine 110 may be adjustable so that the upper frame 111 is level and low to base 100. As shown in FIG. 14, the exercise machine 110 may be adjustable so that the upper frame 111 is level and raised with respect to the base 100. In this configuration, the platform 120 may be raised, such as for taller exercisers, while maintaining a level orientation of the upper frame 111 and track 102 along which the platform 120 moves.

Figure 12:
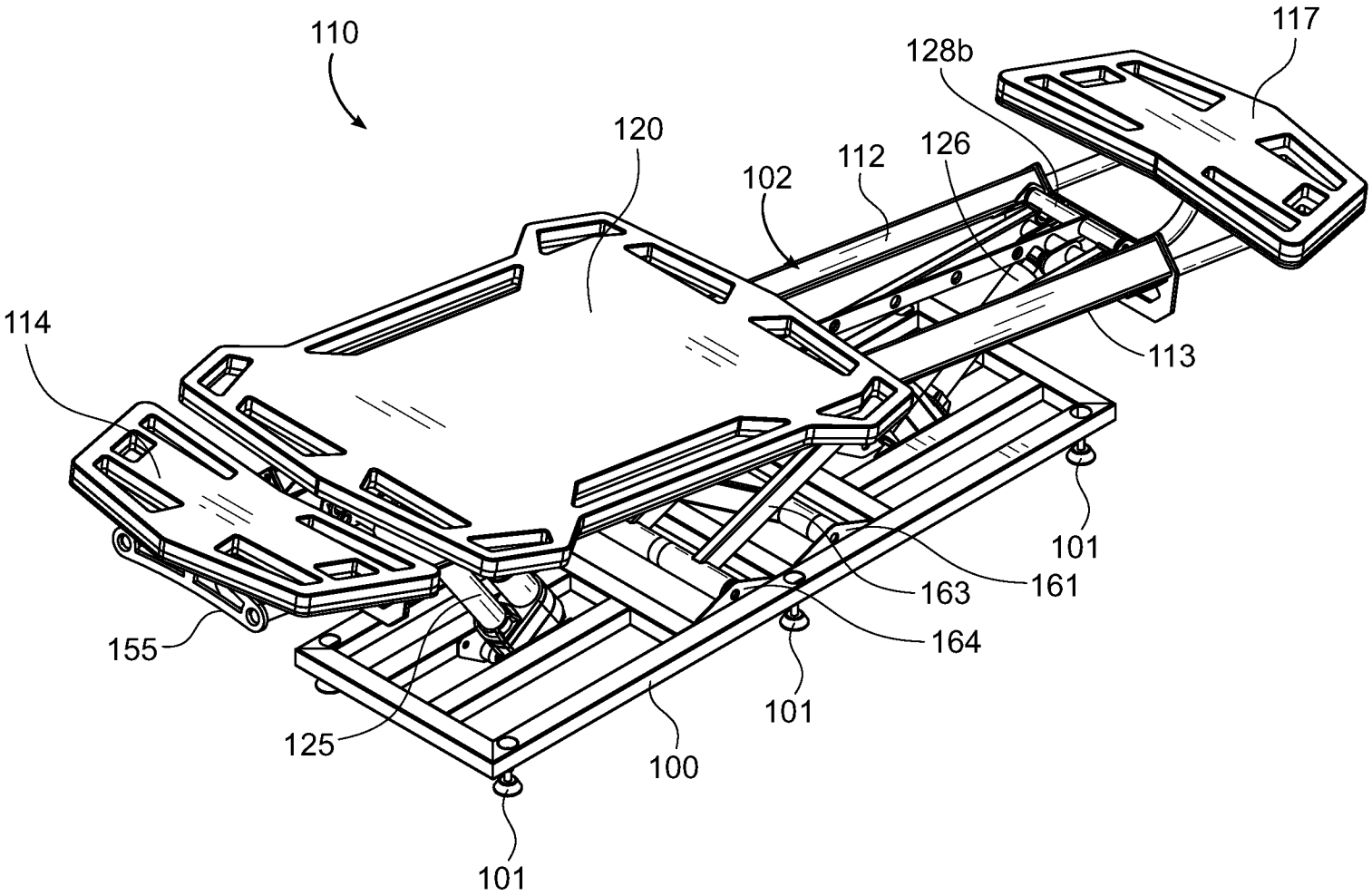
FIG. 12 is an upper perspective view of an adjustable exercise machine with the first end of its upper frame in a lifted position in accordance with an example embodiment.
Figure 13:
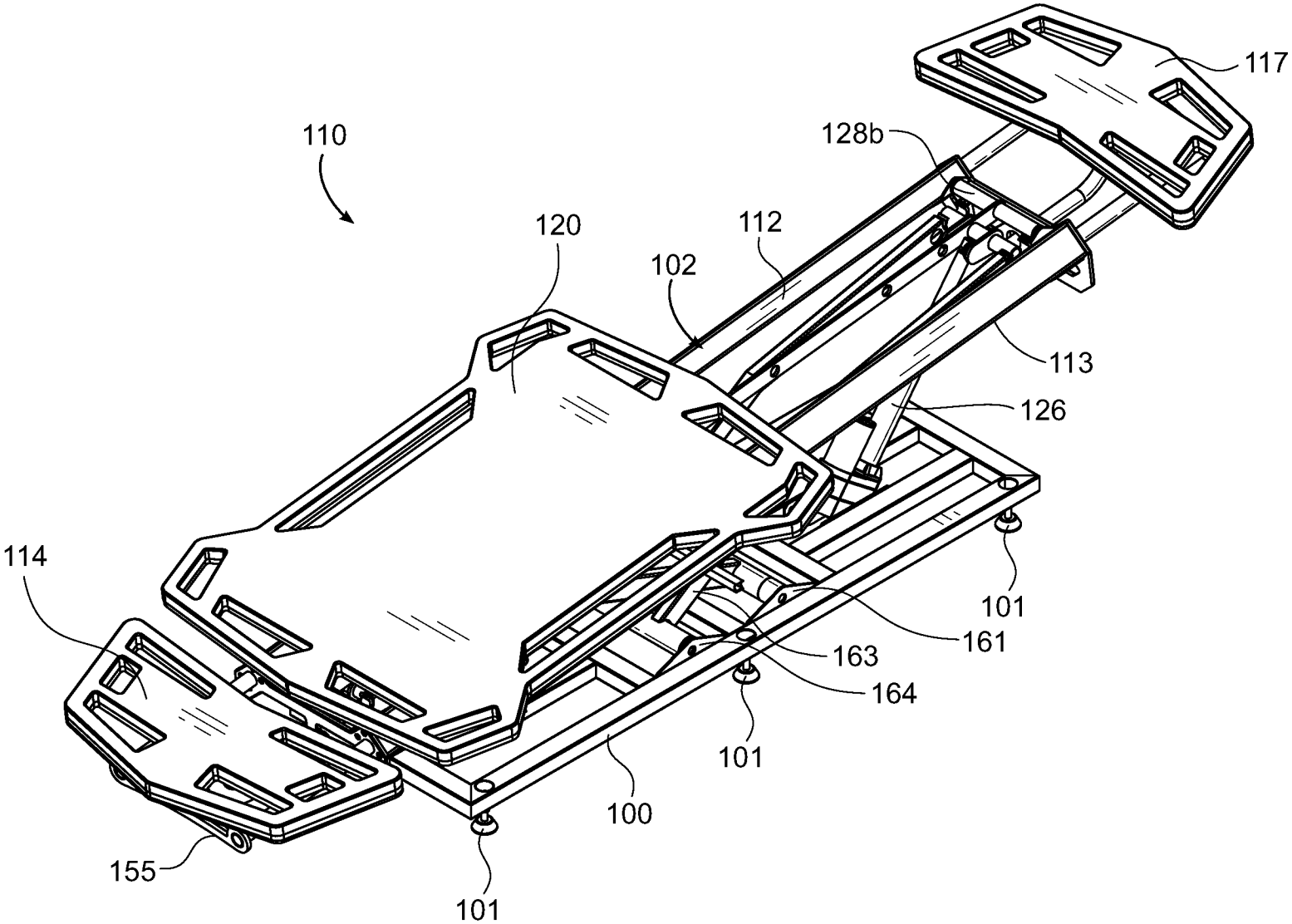
FIG. 13 is an upper perspective view of an adjustable exercise machine with the second end of its upper frame in a lifted position in accordance with an example embodiment.

As shown in FIG. 12, the exercise machine 110 may also be adjustable so that only the first end 155 of the upper frame 111 is raised with the second end 156 remaining lowered, thus forming a declined angle between the first end 155 and the second end 156 of the upper frame 111. As shown in FIG. 13, the exercise machine 110 may be adjustable so that only the second end 156 of the upper frame 111 is raised with the first end 155 remaining lowered, thus forming an inclined angle between the first end 155 and the second end 156 of the upper frame 111.

As shown in FIG. 12, when the first actuator 125 is extended, the first actuator 125 pushes on and raises the first lifting yoke 128*a* of the first lift support 160, thus raising the first end 155 of the upper frame 111 to which the first lifting yoke 128*a* is connected. As shown in FIG. 13, when the first actuator 125 is retracted, the first actuator 125 pulls on and lowers the first lifting yoke 128*a* of the first lift support 160, thus lowering the first end 155 of the upper frame 111 to which the first lifting yoke 128*a* is connected.

As shown in FIG. 13, when the second actuator 126 is extended, the second actuator 126 pushes on and raises the second lifting yoke 128*b* of the second lift support 163, thus raising the second end 156 of the upper frame 111 to which the second lifting yoke 128*b* is connected. As shown in FIG. 12, when the second actuator 126 is retracted, the second actuator 126 pulls on and lowers the second lifting yoke 128*b* of the second lift support 163, thus lowering the second end 156 of the upper frame 111 to which the second lifting yoke 128*b* is connected.

When the first end 155 of the upper frame 111 is raised and the second end 156 of the upper frame 111 is lowered, the front platform 114 will thus be raised, with the back platform 117 being lower than the front platform 114. When the second end 156 of the upper frame 111 is raised and the first end 155 of the upper frame 111 is lowered, the back platform 117 will thus be raised, with the front platform 114 being lower than the back platform 117. When either both ends 155, 156 of the upper frame 111 are raised or both ends 155, 156 of the upper frame 111 are lowered, the front and back platforms 114, 117 will be at a level orientation with respect to each other, both being at the same elevation.

The exerciser may mount the exercise machine 110 and position the exerciser's body appropriately for the exercise(s) to be performed. Alternatively, an exerciser may mount the exercise machine 110 prior to adjusting the elevations of the front and back ends of the exercise machine 110, the machine inclination, and the desired biasing force. Obviously, however, caution should be taken in adjusting the exercise machine 110 while an exerciser is mounted thereon in order to avoid falling as the exercise machine 110 is in motion.

With the exercise machine 110 adjusted to a desired elevation, inclination, and biasing force, the exerciser may perform any desired exercises targeting various muscles and muscle groups. By way of example, an exerciser may perform one type of exercise with the front end of the exercise machine 110 slightly inclined relative to the back end of the exercise machine 110 or vice versa. The exerciser may kneel on the movable platform 120 while leaning forward or rearward and grasping the stationary front or back end platform 114, 117 or one or more of the front or back handles 115, 116, 118, 119. The exerciser may then extend or contract the lower portion of the exerciser's body in a direction away from the front or back end of the exercise machine 110 and toward the opposite end of the exercise machine 110 while continuing to grasp the stationary platform 114, 117 or handles 115, 116, 118, 119.

This exercise movement causes the movable platform 120 to roll toward the back end of the exercise machine 110 against the preset biasing force while supported on the trolley assemblies 129, 130 and rails 112, 113. The trolley assemblies 129, 130 resist and minimize any lateral or uplift movement of the movable platform 120 as it moves. Depending on the selected elevation and inclination settings and the exerciser's position on the exercise machine 110, a portion of the exerciser's weight may also contribute additional force that the exerciser must overcome via muscle exertion to move the movable platform 120 toward the back end of the exercise machine 110.

As the movable platform 120 approaches its limit of travel near the back end of the exercise machine 110, one or more travel limit decelerators 137 engage one or more of the trolley wheel assemblies 129, 130. The travel limit decelerators 137 act to rapidly and smoothly decelerate the movable platform 120 until it comes to a brief pause or stop. The exerciser may then reverse the movement in order to return the movable platform 120 to the initial position near the front end of the exercise machine 110. As the movable platform 120 approaches its limit of travel near the front end of the exercise machine 110, one or more travel limit decelerators 137 again engage one or more of the trolley wheel assemblies 129, 130 and bring and rapidly and smoothly decelerate the movable platform 120 to a brief pause or stop. The exerciser may repeat the foregoing movements as many times as desired. It is noted that the inclination settings of the exercise machine 110 and the resistance to the exerciser's movement provided by the biasing member may be adjusted at any time to increase or decrease the muscle exertion required by the exerciser to perform the exercise.

While one example of a useful exercise has been provided above, it is not intended that the exercise machine 110 as described herein be limited to performing any particular exercises. To the contrary, it will be appreciated that a wide variety of useful exercises may be performed using the exercise machine 110 described herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the safety cover, suitable methods and materials are described above. All publications, patent applications, patents, and other references mentioned herein are incorporated by reference in their entirety to the extent allowed by applicable law and regulations. The example exercise machine described herein may be embodied in other specific forms without departing from the spirit or essential attributes thereof, and it is therefore desired that the present embodiments be considered in all respects as illustrative and not restrictive. Further, any headings utilized within the description are for convenience only and have no legal or limiting effect.

What is claimed is:

1. An exercise machine, comprising:

a frame having at least one rail;

a movable platform moveably connected to the at least one rail and adapted to be moveable along at least a portion of the at least one rail;

at least one biasing member adapted to be removably connected to the movable platform, wherein the at least one biasing member provides a resistance force to the movable platform;

a stationary end platform connected to the frame and positioned near a first end of the frame; and a travel limit decelerator connected to the frame, the travel limit decelerator is adapted to engage the movable platform as the movable platform approaches the stationary end platform, wherein the travel limit decelerator is adapted to smoothly and gently decelerate the movable platform when the movable platform approaches the stationary end platform so that the movable platform is brought to a smooth, gentle, non-damaging stop;

wherein the travel limit decelerator comprises a shaft and a bias device connected to the shaft, wherein the bias device is adapted to provide a bias force to the shaft to smoothly and gently decelerate the movable platform to the non-damaging stop, and wherein the bias device is comprised of a spring or a fluid displacement device.

2. The exercise machine of claim 1, wherein the bias device is comprised of the spring.

3. The exercise machine of claim 1, wherein the bias device is comprised of the spring, wherein the shaft is movably connected to the spring in a linear manner, and wherein the spring is adapted to longitudinally receive a linear movement of the shaft.

4. The exercise machine of claim 1, wherein the bias device is comprised of a fluid displacement cylinder.

5. The exercise machine of claim 1, wherein the shaft has a longitudinal axis of movement that is parallel with respect to a longitudinal axis of the at least one rail.

6. The exercise machine of claim 1, including a plunger attached to a distal end of the shaft, wherein the plunger is adapted to engage the movable platform.

7. The exercise machine of claim 6, wherein a width of the plunger is greater than the width of the shaft.

8. The exercise machine of claim 1, wherein the travel limit decelerator is adapted to engage a structural component of the movable platform.

9. The exercise machine of claim 8, wherein the structural component of the movable platform comprises a trolley assembly.

10. The exercise machine of claim 1, wherein the travel limit decelerator is connected to the at least one rail.

11. The exercise machine of claim 1, wherein the at least one rail is comprised of a first rail and a second rail.

12. The exercise machine of claim 1, including a mount connected to the frame, wherein the travel limit decelerator is connected to the mount.

13. The exercise machine of claim 12, wherein the travel limit decelerator is adjustably positioned with the mount to change a longitudinal position of the shaft with respect to the at least one rail.

14. The exercise machine of claim 13, wherein adjustment of the longitudinal position of the travel limit decelerator within the mount correspondingly adjusts a limit of travel for the movable platform.

15. The exercise machine of claim 13, wherein adjustment of the longitudinal position of the travel limit decelerator within the mount correspondingly adjusts an engagement position of the shaft and the movable platform.

16. The exercise machine of claim 13, including an adjustment mechanism adapted for adjusting the longitudinal position of the travel limit decelerator with respect to the at least one rail.

17. The exercise machine of claim 16, wherein the adjustment mechanism is comprised of a nut and wherein the travel limit decelerator passes through the nut longitudinally, wherein when the nut is loosed the travel limit decelerator is configured to be slid longitudinally with respect to the mount to adjust the longitudinal position of the travel limit decelerator and wherein when the nut is tightened the travel limit decelerator is locked in a stationary position.

18. The exercise machine of claim 12, wherein the mount is connected to the at least one rail.

19. An exercise machine, comprising:

a frame having at least one rail, a first end and a second end opposite the first end, wherein the frame includes a central longitudinal axis and wherein the at least one rail has a longitudinal axis;

a movable platform moveably connected to the at least one rail and adapted to be moveable along at least a portion of the at least one rail;

at least one biasing member adapted to be connected to the movable platform, wherein the at least one biasing member provides a resistance force to the movable platform;

a stationary end platform connected to the frame and positioned near the first end of the frame; and a travel limit decelerator connected to the frame, the travel limit decelerator is adapted to engage the movable platform as the movable platform approaches the stationary end platform, wherein the travel limit decelerator is adapted to smoothly and gently decelerate the movable platform when the movable platform approaches the stationary end platform so that the movable platform is brought to a smooth, gentle, non-damaging stop;

wherein the travel limit decelerator has a longitudinal axis of movement that is parallel with respect to the longitudinal axis of the at least one rail;

wherein the travel limit decelerator is adapted to engage a structural component of the movable platform;

wherein the travel limit decelerator comprises a shaft movably connected to the frame in a linear manner and a spring connected to the shaft, wherein the shaft has a longitudinal axis of movement that is parallel with respect to the longitudinal axis of the at least one rail;

wherein the shaft is adapted to engage the movable platform as the movable platform approaches the stationary end platform, wherein the spring is adapted to provide a bias force to the shaft to smoothly and gently decelerate the movable platform when the movable platform approaches the stationary end platform so that the movable platform is brought to the smooth, gentle, non-damaging stop.

20. An exercise machine, comprising:

a frame having at least one rail, a first end and a second end opposite the first end, wherein the frame includes a central longitudinal axis and wherein the at least one rail has a longitudinal axis;

a movable platform moveably connected to the at least one rail and adapted to be moveable along at least a portion of the at least one rail;

at least one biasing member adapted to be connected to the movable platform, wherein the at least one biasing member provides a resistance force to the movable platform;

a first stationary end platform connected to the frame and positioned near the first end of the frame;

a second stationary end platform connected to the frame and positioned near the second end of the frame; and a travel limit decelerator connected to the frame, the travel limit decelerator is adapted to engage the movable platform as the movable platform approaches the first stationary end platform, wherein the travel limit decelerator is adapted to smoothly and gently decelerate the movable platform when the movable platform approaches the first stationary end platform so that the movable platform is brought to a smooth, gentle, non-damaging stop;

wherein the travel limit decelerator has a longitudinal axis of movement that is parallel with respect to the longitudinal axis of the at least one rail;

wherein the travel limit decelerator is adapted to engage a structural component of the movable platform;

wherein the travel limit decelerator comprises a shaft movably connected to the frame in a linear manner and a spring connected to the shaft, wherein the shaft has a longitudinal axis of movement that is parallel with respect to the longitudinal axis of the at least one rail, wherein the shaft is adjustably positioned with the frame to change a longitudinal position of the shaft with respect to the frame, and wherein adjustment of the longitudinal position of the travel limit decelerator correspondingly adjusts a limit of travel for the movable platform;

wherein the shaft is adapted to engage the movable platform as the movable platform approaches the first stationary end platform, wherein the spring is adapted to provide a bias force to the shaft to smoothly and gently decelerate the movable platform when the movable platform approaches the first stationary end platform so that the movable platform is brought to the smooth, gentle, non-damaging stop.

* * * * *